US010518548B2

(12) United States Patent
Yamada et al.

(10) Patent No.: US 10,518,548 B2
(45) Date of Patent: Dec. 31, 2019

(54) LIQUID EJECTION HEAD, LIQUID EJECTION APPARATUS AND METHOD OF MANUFACTURING LIQUID EJECTION HEAD

(71) Applicant: CANON KABUSHIKI KAISHA, Tokyo (JP)

(72) Inventors: Kazuhiro Yamada, Yokohama (JP); Shuzo Iwanaga, Kawasaki (JP); Seiichiro Karita, Saitama (JP); Shingo Okushima, Kawasaki (JP); Zentaro Tamenaga, Sagamihara (JP); Noriyasu Nagai, Tokyo (JP); Tatsurou Mori, Yokohama (JP); Akio Saito, Machida (JP); Akira Yamamoto, Yokohama (JP); Asuka Horie, Yokohama (JP); Masao Furukawa, Yokohama (JP); Takatsuna Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/018,454

(22) Filed: Jun. 26, 2018

(65) Prior Publication Data

US 2019/0001697 A1 Jan. 3, 2019

(30) Foreign Application Priority Data

Jun. 30, 2017 (JP) ..... 2017-129726

(51) Int. Cl.
*B41J 2/175* (2006.01)
*B41J 2/045* (2006.01)
(Continued)

(52) U.S. Cl.
CPC ..... *B41J 2/17596* (2013.01); *B41J 2/0458* (2013.01); *B41J 2/05* (2013.01);
(Continued)

(58) Field of Classification Search
CPC ..... B41J 2/0458; B41J 2/05; B41J 2/14024; B41J 2/1404; B41J 2/1603; B41J 2/1623;
(Continued)

(56) References Cited

U.S. PATENT DOCUMENTS 4,994,825 A 2/1991 Saito et al.
5,826,333 A 10/1998 Iketani et al.
(Continued)

FOREIGN PATENT DOCUMENTS

JP 2006-256049 A 9/2006

OTHER PUBLICATIONS

U.S. Appl. No. 15/976,470, Kazuhiro Yamada, Toru Nakakubo, Yoshiyuki Nakagawa, Shingo Okushima, filed May 10, 2018.
(Continued)

*Primary Examiner* — Juanita D Jackson
(74) *Attorney, Agent, or Firm* — Venable LLP

(57) ABSTRACT

A liquid ejection head has a plurality of ejection modules having a recording element substrate equipped with a plurality of ejection orifices for ejecting a liquid, a plurality of first flow path members that supports at least one of the ejection modules and a second flow path member provided in common with the first flow path members and supporting the first flow path members. The first flow path members and the second flow path member are equipped with a flow path for supplying a plurality of recording element substrates with a liquid. The first flow path members are joined with the second flow path member via an adhesive layer without being brought into direct contact with the second flow path member.

14 Claims, 16 Drawing Sheets

(51) Int. Cl.
*B41J 2/14* (2006.01)
*B41J 2/16* (2006.01)
*B41J 2/05* (2006.01)

(52) U.S. Cl.
CPC ..... *B41J 2/1404* (2013.01); *B41J 2/1623* (2013.01); *B41J 2/1631* (2013.01)

(58) Field of Classification Search
CPC ..... B41J 2/1631; B41J 2/17546; B41J 2/18; B41J 2/17596
See application file for complete search history.

(56) References Cited

U.S. PATENT DOCUMENTS 5,933,163 A 8/1999 Koizumi et al.
6,652,702 B2 11/2003 Miyazaki et al.
6,749,287 B2 6/2004 Osada et al.
8,851,660 B2 10/2014 Furukawa
9,126,409 B2 9/2015 Tamenaga et al.
9,221,257 B2 12/2015 Moriya et al.
9,248,647 B2 2/2016 Iwanaga et al.
9,254,658 B2 2/2016 Yamada et al.
9,452,606 B2 9/2016 Yamada
9,469,111 B2 10/2016 Yamada et al.
9,744,760 B2 8/2017 Yamada et al.
9,931,845 B2 4/2018 Moriya et al.
9,962,937 B2 5/2018 Okushima et al.
10,022,979 B2 7/2018 Okushima et al.
2008/0239004 A1* 10/2008 Iwanaga et al. ..... 347/54
2017/0197409 A1 7/2017 Okushima et al.
2017/0197419 A1 7/2017 Okushima et al.
2017/0313076 A1 11/2017 Okushima et al.
2018/0304630 A1 10/2018 Okushima et al.
2018/0333955 A1 11/2018 Oikawa et al.

OTHER PUBLICATIONS

U.S. Appl. No. 15/995,493, Toru Nakakubo, Takuro Yamazaki, Kazuhiro Yamada, Yoshiyuki Nakagawa, filed Jun. 1, 2018.
U.S. Appl. No. 16/023,369, Koichi Kubo, Naozumi Nabeshima, Soji Kondo, Kazuya Yoshii, Noriyasu Nagai, filed Jun. 29, 2018.
U.S. Appl. No. 16/025,371, Soji Kondo, Naozumi Nabeshima, Koichi Kubo, Kazuya Yoshii, Noriyasu Nagai, filed Jul. 2, 2018.

* cited by examiner

LIQUID EJECTION HEAD, LIQUID EJECTION APPARATUS AND METHOD OF MANUFACTURING LIQUID EJECTION HEAD

BACKGROUND OF THE INVENTION

Field of the Invention

The present invention relates to a liquid ejection head and a method of manufacturing same, and a liquid ejection apparatus using the liquid ejection head.

Description of the Related Art

A liquid ejection apparatus that performs recording by ejecting a liquid to a recording medium uses a liquid ejection head equipped with one or more recording element substrates having therein an ejection orifice, a pressure chamber communicated with the ejection orifice, and a recording element for giving ejecting energy to a liquid in the pressure chamber. A surface of the recording element substrate from which a plurality of ejection orifices formed is exposed is called "ejection orifice face". For high speed recording to a recording medium, a page-wide type liquid ejection head having a plurality of recording element substrates placed over a width at least equal to the width of a recording medium has been put to practical use. The page-wide type liquid ejection head is required to have high speed recording performance and also high recording quality suited for commercial printing applications so that high position accuracy among the recording element substrates is required. In particular, if there occurs, between recording element substrates adjacent to each other, a difference in distance between respective ejection orifices of the substrates and a recording medium, time lag occurs at the time of high speed recording between ejection of a liquid and arrival of it to the recording medium, that is, between ejection and landing of it on the recording medium, causing degradation in recording quality such as uneven recording. Insufficient parallelism of the ejection orifice face to the recording medium also causes degradation in recording quality due to the incorrect landing position of the ejected liquid. Degradation in recording quality due to such reasons becomes more marked when a recording rate is higher.

As the page-wide type liquid ejection head, known is that having a constitution obtained by placing one recording element substrate on an individual support member to constitute an ejection module and placing two or more ejection modules in parallel with each other on a long support member (called "common support member). In this case, in order to reduce variation in distance between an ejection orifice face and a recording medium in each recording element substrate, it is necessary to carry out high-precision processing with the thickness tolerance of each ejection module, flatness (warpage, waviness) of the joint surface between the ejection module and the common support member, and the like in consideration. Such high-precision processing, however, demands a high cost. Japanese Patent Application Laid-Open No. 2006-256049 discloses that a plurality of ejection modules is fixed onto the flat surface of a jig with an ejection orifice face down and a common support member having a spacer member for each ejection module is brought close to the ejection module downwardly to join them with an adhesive. The spacer member is equipped with a space holding screw to prevent a space between the ejection module and the common support member from changing even by shrinkage caused during curing of the adhesive.

When the constitution disclosed in Japanese Patent Application Laid-Open No. 2006-256049 is used, it is necessary to select the amount of the adhesive so as to compensate for the thickness tolerance of each ejection module and also the thickness tolerance of the spacer member and warpage of the common support member and then, adjust the space holding screw provided for the space member. This makes the steps of manufacturing a liquid ejection head cumbersome, leading to a cost increase.

SUMMARY OF THE INVENTION

The invention is directed to providing a liquid ejection head and a method of manufacturing it capable of reducing variation in the position of an ejection orifice face among a plurality of recording element substrates and improving, at a low cost, the parallelism of the ejection orifice face with a recording medium. The invention is also directed to providing a liquid ejection apparatus using such a liquid ejection head.

The liquid ejection head of the invention is equipped with a plurality of ejection modules having a recording element substrate equipped with a plurality of ejection orifices that eject a liquid, a plurality of first flow path members that supports at least one of the ejection modules, and a second flow path member that is provided in common to the first flow path members and supports the first flow path members. In this liquid ejection head, the first flow path members and the second flow path member are equipped with a flow path for supplying the recording element substrate with the liquid and the first flow path members and the second flow path member are not in direct contact but are joined with each other via an adhesive layer.

The liquid ejection apparatus of the invention is equipped with the liquid ejection head of the invention and a storage unit for storing a liquid therein.

The method of manufacturing a liquid ejection head according to the invention has a step of placing a plurality of first flow path members at a predetermined position on a first stage while turning a joint surface of the first flow path members with an ejection module in a downward vertical direction, a step of applying an adhesive to at least one of a joint surface of a second flow path member with the first flow path members and a joint surface of the first flow path members with the second flow path member except an opening for a flow path, installing the second flow path member on a second stage so that the second flow path member is positioned in a upward vertical direction of the first flow path members placed at the predetermined position on the first stage while turning the joint surface of the second flow path member with the first flow path members in the downward vertical direction, and a step of moving at least one of the first stage and the second stage in a vertical direction and thereby bonding the first flow path members to the second flow path member via an adhesive without bringing them into direct contact with each other.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Constitution examples and embodiment examples to which the invention can be applied will hereinafter be described in accordance with the accompanying drawings. The scope of the invention is determined by the description of the attached claims and the scope of the invention is not limited by the following description. In particular, the scope of the invention is not limited by the configuration, arrangement, or the like described hereinafter. In the following description, a so-called thermal type liquid ejection head using a heater element as a recording element that generates liquid ejection energy and creating air bubbles in a liquid in a pressure chamber by heat to eject the liquid from an ejection orifice will be described as one example. A liquid ejection head to which the invention can be applied is not only of a thermal liquid system, but also of a piezoelectric system using a piezoelectric element and liquid ejection heads using other various liquid ejection systems.

A liquid ejection head to be used in a liquid ejection apparatus that circulates a liquid such as recording liquid (for example, ink) between a tank and a liquid ejection head will hereinafter be described, but a liquid ejection apparatus using the liquid ejection head based on the invention is not limited to the above-described one. The invention can also be applied to a liquid ejection apparatus which is not a liquid circulation type but pours the liquid from one of respective tanks provided on the upstream side and the downstream side to the other tank via the liquid ejection head to cause the liquid to flow in a pressure chamber of the liquid ejection head. In addition, with respect to a liquid to be ejected, a liquid ejection head or a liquid ejection apparatus ejecting a liquid other than the recording liquid may be used.

Further, in the following description, the liquid ejection head is constituted as a so-called page-wide type head having a length corresponding to the width of a recording medium. The invention can, however, be applied also to a so-called serial type liquid ejection head which completes recording on a recording medium by scanning in a main scanning direction and in a sub-scanning direction. The serial type liquid ejection head may be one that records on a recording medium by scanning with a line head having several recording element substrates arranged in an ejection orifice row direction so that the ejection orifices overlap with each other and having a length shorter than the width of the recording medium. In the liquid ejection head, a plurality of ejection orifices is arranged in a row in one direction and such a row is called "ejection orifice row". A direction in which the ejection orifice row extends is called "ejection orifice row direction".

Description of Liquid Ejection Apparatus

Figure 1:
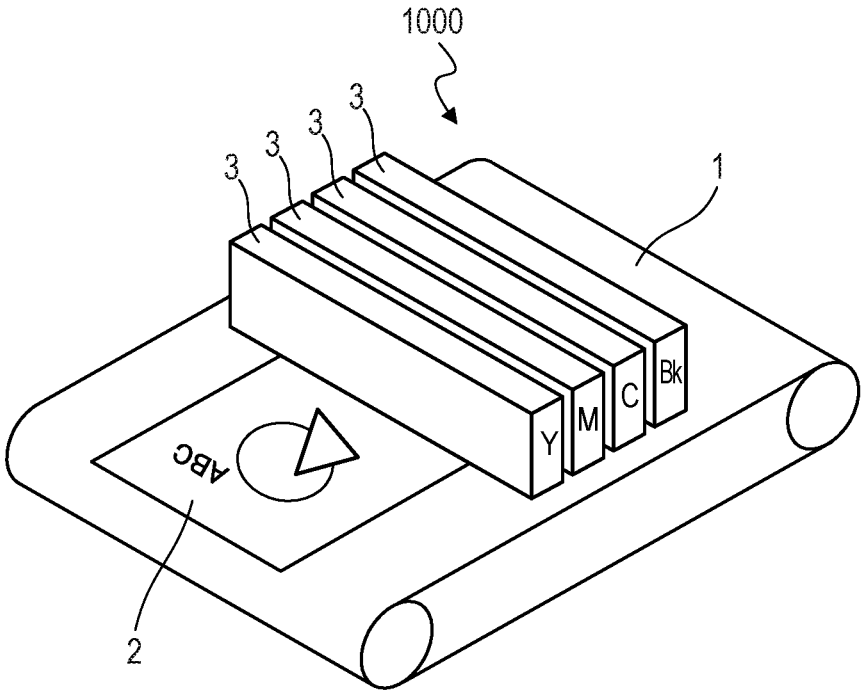
FIG. 1 is a view showing the schematic constitution of a liquid ejection apparatus.

As one example of a liquid ejection apparatus using the liquid ejection head based on the invention, an ink jet recording apparatus 1000 (which may also be called "recording apparatus") which ejects, as a liquid, a recording liquid from an ejection orifice and thereby performs recording on a recording medium will be described. FIG. 1 shows the schematic constitution of the recording apparatus 1000 which is a liquid ejection apparatus of a first constitution example. The recording apparatus 1000 is a page-wide type recording apparatus that is equipped with a conveyance unit 1 which conveys a recording medium 2 and a page-wide type liquid ejection head 3 placed in a direction substantially perpendicular to the conveying direction of the recording medium 2 and performs continuous recording by one pass while continuously or intermittently conveying a plurality of recording media 2. The recording medium 2 is, for example, cut paper, but not only cut paper but also continuous roll paper may be used. In the recording apparatus 1000, four liquid ejection heads 3 for single colors, that is, cyan (C), magenta (M), yellow (Y), and black (K) colors, respectively, are arranged in parallel to each other. By using them, full-color recording can be performed on the recording medium 2. In the following description, cyan (C), magenta (M), yellow (Y), and black (K) colors may be called "CMYK", collectively. Each of the liquid ejection heads 3 is provided with, for example, 20 ejection orifice rows in a direction perpendicular to the ejection orifice row direction. By providing a plurality of ejection orifice rows and performing recording while allocating recording data to these ejection orifice rows as needed, recording can be performed at very high speed. Even when one of the ejection orifices fails to eject, a liquid can be ejected complementarily from an ejection orifice of another row at a position corresponding to the defective nozzle so that this liquid ejection head can have improved reliability. When the liquid ejection heads 3 for respective colors are used, however, the positions of the ejection orifices or distances therebetween in the longitudinal direction of the liquid ejection heads 3 for respective colors should be adjusted with high precision from the standpoint of color matching among the heads. For high-speed recording, from the standpoint of accuracy of the landing position of a liquid ejected from an ejection orifice, the position of the ejection orifice rows or distance therebetween in each liquid ejection head should be adjusted with high precision. In addition, the parallelism between the ejection orifice face and the recording medium should also be adjusted with high precision. Although not shown in FIG. 1, each of the liquid ejection heads 3 has an electric control unit electrically connected thereto and transmitting electric power and ejection control signals to the liquid ejection head 3.

Description of First Circulation Type

Figure 2:
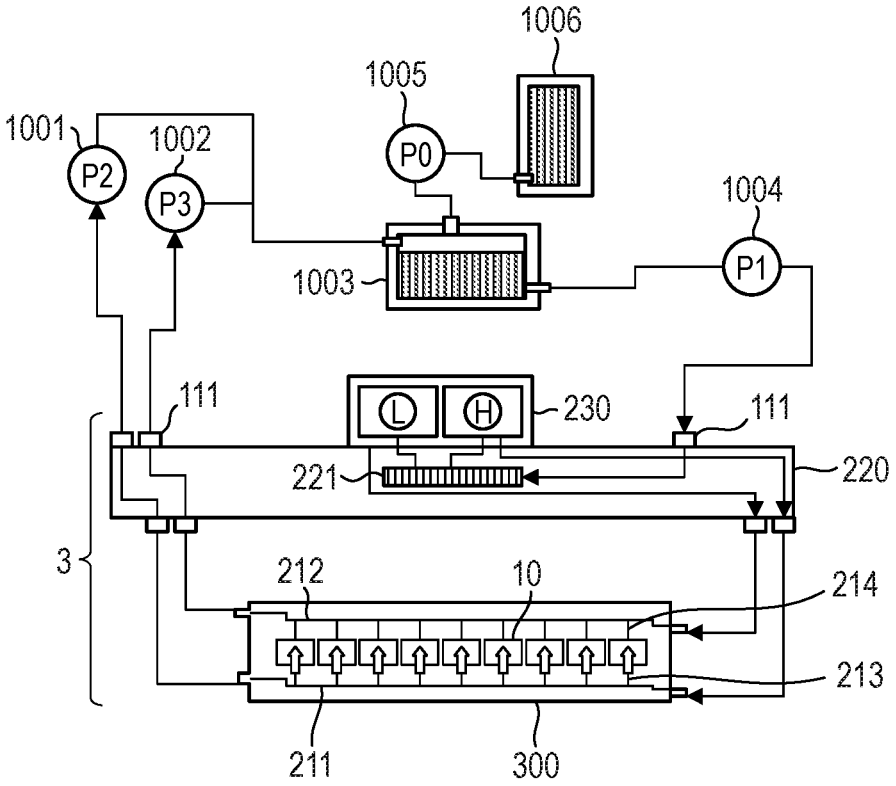
FIG. 2 is an explanatory diagram of a first circulation type.

FIG. 2 shows a first circulation type, that is, one example of the constitution of a circulation route in a liquid ejection apparatus using the liquid ejection head device based on the invention. In the first circulation type, the liquid ejection head 3 is fluidly connected to a high-pressure side first circulation pump 1001, a low-pressure side first circulation pump 1002, a buffer tank 1003 and the like. To simplify the description, FIG. 2 shows only a route through which one of CMYK-color recording liquids flows, but in an actual recording apparatus 1000, each of the liquid ejection heads 3 is provided with this route. The buffer tank 1003 to be connected with a main tank 1006 and serving as a sub-tank functions as a storage unit for storing therein a recording liquid and having an air communication port (not shown in the drawing) that communicates between the inside and the outside of the tank so that it can discharge the air bubbles from the recording liquid to the outside. The buffer tank 1003 is connected also to a replenishing pump 1005. When the recording liquid is ejected (discharged) from the ejection orifice of the liquid ejection head and the liquid is consumed at the liquid ejection head 3 for recording or suction recovery by ejecting the recording liquid, the replenishing pump 1005 transfers a consumed amount of the recording liquid from the main tank 1006 to the buffer tank 1003.

Two first circulation pumps 1001 and 1002 have a role of drawing the liquid from a liquid connection unit 111 of the liquid ejection head 3 and causing it to flow to the buffer tank 1003. As the first circulation pumps 1001 and 1002, using a positive displacement pump having constant liquid feeding ability is preferred. Specific examples include a tube pump, a gear pump, a diaphragm pump and a syringe pump. Further, for example, a pump that has an ordinary constant flow rate valve or relief valve at the outlet of the pump to secure a constant flow rate can also be used. When the liquid ejection head 300 operates, the recording liquid flows in a common supply flow path 211 and a common collection flow path 212 at a certain flow rate by the high-pressure side first circulation pump 1001 and the low-pressure side first circulation pump 1002, respectively. The flow rate is preferably set so that a temperature difference among the recording element substrates 10 in the liquid ejection head 3 becomes at least a degree not affecting the recording quality on the recording medium 2. When the flow rate thus set is excessively large, there occurs density unevenness in a recorded image because due to the influence of a pressure drop of the flow path in the liquid ejection unit 300, a difference in negative pressure among the recording element substrates 10 becomes too large. It is therefore preferred to set the flow rate while considering the temperature difference and the negative pressure difference among the recording element substrates 10. Between the routes through which the recording liquid circulates, the route including the high-pressure side first circulation pump 1001 constitutes a first circulation system in this liquid ejection apparatus and the route including the low-pressure side first circulation pump 1002 constitutes a second circulation system in this liquid ejection apparatus.

The route for supplying the recording liquid from the buffer tank 1003 to the liquid ejection head 3 is provided with a second circulation pump 1004. A negative pressure control unit 230 functions as a negative pressure control means and is provided in a route between the second circulation pump 1004 and the liquid ejection unit 300. The negative pressure control unit 230 has a function of keeping the pressure downstream of the negative pressure control unit 230 (in other words, on the side of the liquid ejection unit 300) to a constant pressure set in advance even if a flow rate of the circulation system varies due to a difference in duty at the time of recording. The negative pressure control unit 230 is equipped with two pressure adjustment mechanisms set to have respectively different control pressures. As these two pressure regulating mechanisms, any mechanisms can be used insofar as they can control the variation in the pressure downstream of these mechanisms to fall within a predetermined range or less with a desired set pressure as a center. As one example, a mechanism similar to that of a so-called pressure reducing regulator can be used. When a pressure reducing regulator is used as the pressure regulating mechanism, it is preferred to apply pressure, by the second circulation pump 1004, the upstream side of the negative pressure control unit 230 via the liquid supply unit 220 as shown in FIG. 2. This makes it possible to suppress the influence of a water load on the liquid ejection head 3 of the buffer tank 1003 and thereby widen the degree of freedom of the layout of the buffer tank 1003 in the recording apparatus 1000. As the second circulation pump 1004, any one is usable insofar as it has a lift pressure equal to or more than a predetermined pressure within a range of the circulation flow rate of the recording liquid used at the time of driving the liquid ejection head 3 and a turbo pump or a positive displacement pump can be used. More specifically, a diaphragm pump or the like can be used. Instead of the second circulation pump 1004, for example, a water header tank placed with a certain water head difference with respect to the negative pressure control unit 230 may be provided.

Of the two pressure regulating mechanisms in the negative pressure control unit 230, the pressure regulating mechanism set to have a relatively high pressure (indicated by H in FIG. 2) is connected to the common supply flow path 211 in the liquid ejection unit 300 via the liquid supply unit 220. Similarly, the pressure regulating mechanism set to have a relatively low pressure (indicated by L in FIG. 2) is connected to the common collection flow path 212 in the liquid ejection unit 300 via the liquid supply unit 220. The liquid ejection unit 300 is provided with, in addition to the common supply flow path 211 and the common collection flow path 212, individual supply flow paths 213 and individual collection flow paths 214 communicated respectively with the recording element substrates 10. The individual supply flow paths 213 and the individual collection flow paths 214 provided respectively for the recording element substrates are called "individual flow paths", collectively. Each individual flow path is branched from the common supply flow path 211 to merge into the common collection flow path 212 and is communicated with them. There therefore occurs a flow (a blank arrow in FIG. 2) of a portion of a liquid such as recording liquid starting from the common supply flow path 211, passing through the inside flow path of the recording element substrate 10 and reaching the common collection flow path 212. This flow is generated because the high-pressure side pressure regulating mechanism H is connected to the common supply flow path 211 and the low-pressure side control mechanism L is connected to the common collection flow path 212 so that a pressure difference appears between the common supply flow path 211 and the common collection flow path 212.

Thus, in the liquid ejection unit 300, there occurs such a flow that a liquid is caused to pass through the common supply flow path 211 and the common collection flow path 212 while a portion of the liquid is caused to pass through each of the recording element substrates 10. The heat generated at each of the recording element substrates 10 can therefore be discharged outside of the recording element substrate 10 by the flow through the common supply flow path 211 and the common collection flow path 212. During recording using the liquid ejection head 3, a flow of the recording liquid can be generated even in the ejection orifice or pressure chamber not engaged in recording, making it possible to suppress an increase in the viscosity of the recording liquid due to evaporation of a solvent component of the recording liquid at these sites. Further, a thickened recording liquid or a foreign matter in the recording liquid can be discharged to the common collection flow path 212. As a result, high speed and high quality recording can be achieved using the above-described liquid ejection head 3.

Description of Second Circulation Type

Figure 3:
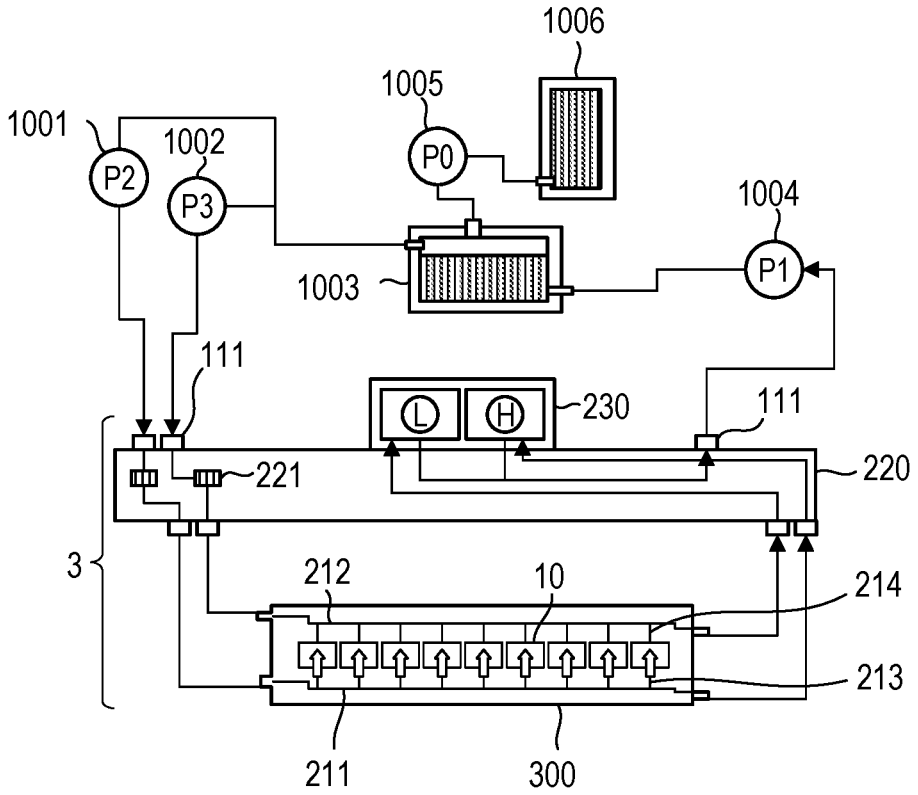
FIG. 3 is an explanatory diagram of a second circulation type.

FIG. 3 shows, of the circulation routes of the liquid ejection apparatus using the liquid ejection head device based on the invention, a second circulation type different from the above-described first circulation type. A main difference of the second circulation type from the first circulation type is that two pressure regulating mechanisms constituting the negative pressure control unit 230 are both a mechanism of controlling the pressure variation upstream side of the negative pressure control unit 230 to fall within a predetermined range with a desired set pressure as a center. Such a pressure regulating mechanism can be constituted as a mechanism element having action similar to that of a so-called back pressure regulator. In addition, a second circulation pump 1004 acts as a negative pressure source for reducing the pressure on the downstream side of the negative pressure control unit 230, while the high-pressure side and low-pressure side first circulation pumps 1001 and 1002 are placed on the upstream side of the liquid ejection head 3. The negative pressure control unit 230 is therefore placed on the downstream side of the liquid ejection head 3.

In the second circulation type, the negative pressure control unit 230 operates so as to make pressure variation on the upstream side thereof stable to fall within a predetermined range with the preset pressure as a center even when variation in flow rate occurs due to a change in recording duty during recording by the liquid ejection head 3. Here, the upstream side of the negative pressure control unit 230 is on the side of the liquid ejection unit 300. As shown in FIG. 3, the second circulation pump 1004 is preferably used to apply a pressure to the downstream side of the negative pressure control unit 230 via the liquid supply unit 220. This makes it possible to control the influence of the water head pressure of the buffer tank 1003 on the liquid ejection head 3 and thereby allow wide selection of the layout of the buffer tank 1003 in the recording apparatus 1000. The second circulation pump 1004 may be replaced with, for example, a water header tank placed with a predetermined water head difference with respect to the negative pressure control unit 230.

As shown in FIG. 3, the negative pressure control unit 230 is, as in the case of the first circulation type, equipped with two pressure regulating mechanisms set to have respectively different control pressures. The pressure regulating mechanism on the side set at high pressure (indicated by H in FIG. 3) and the pressure regulating mechanism on the side set at low pressure (indicated by L in FIG. 3) are connected to a common supply flow path 211 and a common collection flow path 212 in the liquid ejection unit 300, respectively, via the liquid supply unit 220. Since the pressure of the common supply flow path 211 is set relatively higher than the pressure of the common collection flow path 212 by these two pressure regulating mechanisms, there occurs a flow of a recording liquid starting from the common supply flow path 211, passing through the individual flow paths and the inside flow path of each of the recording element substrates 10, and reaching the common collection flow path 212. The flow of the recording liquid is indicated by a blank arrow in FIG. 3. Thus, a flow state of the recording liquid in the second circulation type is similar to that in the first circulation type in the liquid ejection unit 300, but the former one has two advantages different from the latter one.

The first advantage of the second circulation type is that since the negative pressure control unit 230 is placed on the downstream side of the liquid ejection head 3, there is little fear of a dust or a foreign matter derived from the negative pressure control unit 230 flowing into the liquid ejection head 3.

The second advantage of the second circulation type is that the maximum required flow rate of the liquid supplied from the buffer tank 1003 to the liquid ejection head 3 is lower than that in the first circulation type. The following is the reason for it. Suppose that the sum of the flow rate in the common supply flow path 211 and that in the common collection flow path 212 is (A) during circulation at the time of recording standby. The value of (A) is defined as the minimum flow rate necessary for controlling a temperature difference in the liquid ejection unit 300 to fall within a desired range when the temperature of the liquid ejection head 3 is adjusted during recording standby. The ejection flow rate in the case where the recording liquid is ejected from all the ejection orifices of the liquid ejection unit 300 (at the time of full ejection) is defined as (F). In the first circulation type shown in FIG. 2, the set flow rate of the first circulation pump (high-pressure side) 1001 and the first circulation pump (low-pressure side) 1002 is (A) so that the maximum liquid supply amount to the liquid ejection head 3 necessary at the time of full ejection becomes (A)+(F). In the second circulation type shown in FIG. 3, on the other hand, the liquid supply amount to the liquid ejection head 3 necessary at the time of recording standby is the flow rate (A). The supply amount to the liquid ejection head 3 necessary at the time of full ejection becomes the flow rate (F). Then, in the second circulation type, the sum of the set flow rate of the high-pressure side first circulation pump 1001 and the low-pressure side first circulation pump 1002, that is, the maximum required supply flow rate becomes a larger value of (A) and (F). The maximum required supply amount ((A) or (F)) in the second circulation type necessarily becomes smaller than the maximum required supply flow rate ((A)+(F)) in the first circulation type insofar as the liquid ejection unit 300 having the same constitution is used. This enhances the degree of freedom of a circulation pump usable in the second circulation type and makes it possible, for example, to use an inexpensive circulation pump having a simple constitution or to reduce a burden of a cooler (not shown in the drawing) installed in the route on the side of the main body, leading to a reduction in the cost of the main body of the recording apparatus. This advantage becomes greater when the head is a page-wide type head having a relatively larger (A) or (F) and further, the page-wide type head is longer in the longitudinal direction.

On the other hand, the first circulation type is more advantageous than the second circulation type in the following respect. The flow rate of the liquid flowing in the liquid ejection unit 300 during recording standby is the maximum in the second circulation type so that a higher negative pressure is applied to each of the ejection orifices when an image has a lower recording duty. In particular, when the flow path width of the common supply flow path 211 and the common collection flow path 212 is made shorter to decrease the width of the head, there is a fear that an influence of satellite droplets increases because a high negative pressure is applied to the ejection orifices in a low duty image from which unevenness can be seen easily. Here, the flow path width of the common supply flow path 211 and the common collection flow path 212 is a length in a direction orthogonal to the liquid flow direction and the head width is a length in the short direction of the liquid ejection head 3. In the first circulation type, on the other hand, a high negative pressure is applied to the ejection orifice at the time of forming a high duty image. Satellite droplets, if any, cannot be viewed easily from the recorded image, providing an advantage that the influence on the image is small. A preferable one of these two circulation types is therefore selected in consideration of the specification of the liquid ejection head 3 and the main body of the recording apparatus (ejection flow rate (F), minimum circulation flow rate (A), and flow path resistance in the liquid ejection head 3).

Description of Structure of Liquid Ejection Head

Figure 4A:
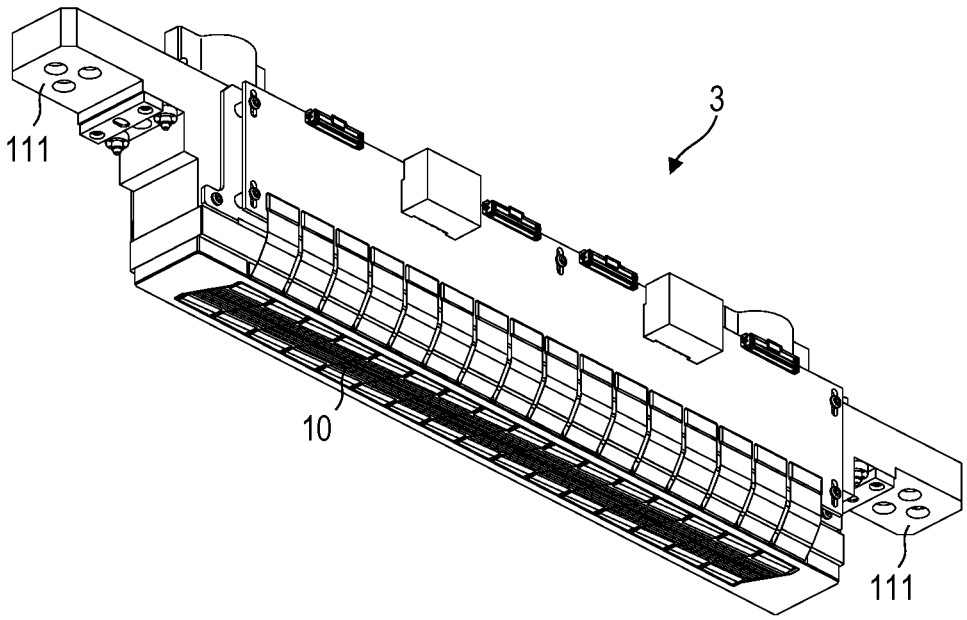
FIGS. 4A and 4B are each a perspective view showing the constitution of a liquid ejection head.
Figure 4B:
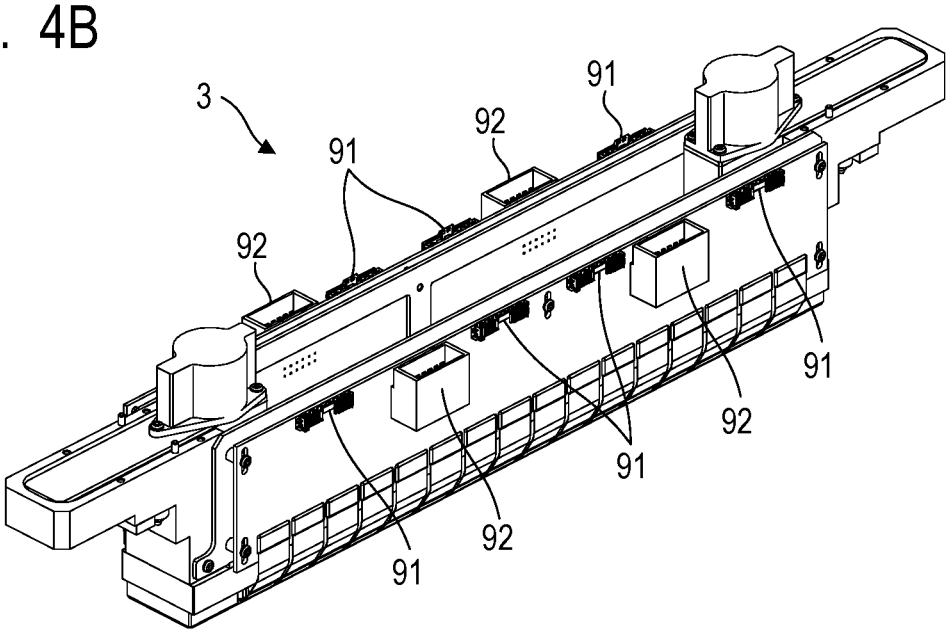

Next, the constitution of each of the liquid ejection heads 3 will be described referring to FIGS. 4A and 4B. FIG. 4A is a perspective view of the liquid ejection head 3 viewed from the side of a surface having thereon ejection orifices and FIG. 4B is a perspective view of the head viewed from a direction contrary to the direction of FIG. 4A. The liquid ejection head 3 is a line type liquid ejection head equipped with 16 recording element substrates 10 to be arranged (arranged inline) on a straight line in the longitudinal direction of the head and it is for ink jet system for recording with a single-color recording liquid. The liquid ejection head 3 is equipped with, in addition to the above-described liquid connection unit 111, signal input terminals 91 and power supply terminals 92. The signal input terminals 91 and the power supply terminals 92 are electrically connected to a control circuit of the recording apparatus 1000 and they have a function of supplying the recording element substrates 10 with an ejection drive signal and electric power necessary for ejection, respectively. As is apparent from FIGS. 4A and 4B, the signal input terminals 91 and the power supply terminals 92 are designed according to an electric circuit in an electric wiring substrate 90 (refer to FIG. 5) so as to require the number smaller than the number of the recording element substrates 10. This makes it possible to reduce the number of electric connection units which must be removed when the liquid ejection head 3 is attached to the recording apparatus 1000 or when the liquid ejection head is exchanged. The liquid ejection head 3 of the present embodiment has many ejection orifice rows so that the liquid ejection head 3 has, on both sides thereof, the signal input terminals 91 and the power supply terminals 92 in order to reduce voltage reduction or signal transmission lag at a wiring unit provided in the recording element substrate 10. As shown in FIG. 4A, the liquid connection unit 111 provided at both end portions of the liquid ejection head 3 is connected to, for example, a liquid supply system of the recording apparatus 1000 as shown in FIG. 2 or FIG. 3. Due to such a structure, the recording liquid is supplied from the supply system of the recording apparatus 1000 to the liquid ejection head 3 and the recording liquid passing through the liquid ejection head 3 is collected in the supply system of the recording apparatus 1000. Thus, the recording liquid can be circulated via the route of the recording apparatus 1000 and the route of the liquid ejection head 3.

Figure 5:
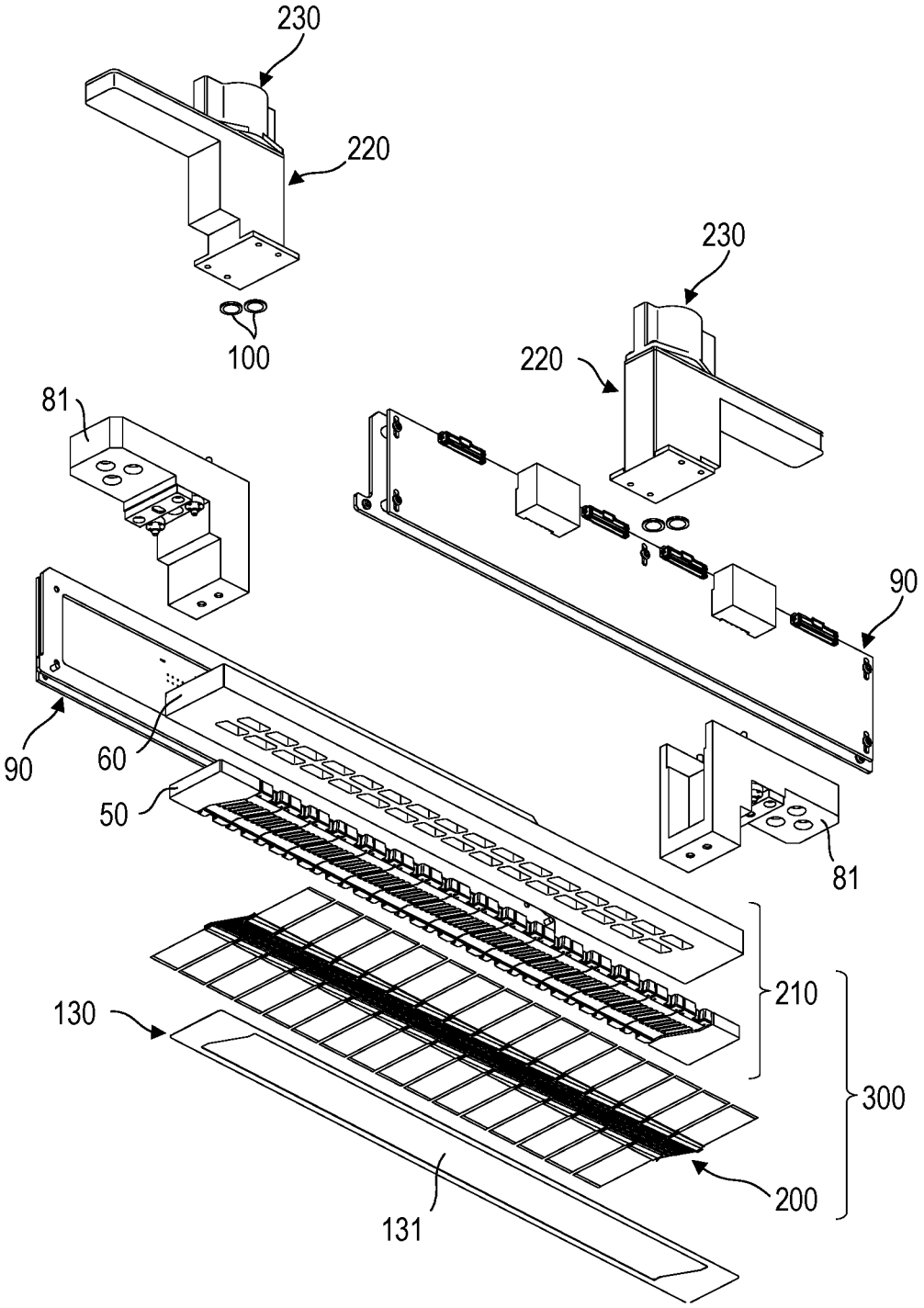
FIG. 5 is an exploded perspective view showing a liquid ejection head.

FIG. 5 is an exploded perspective view of the liquid ejection head 3 in which the liquid ejection head 3 is separated according to function into each part or unit constituting it. In the liquid ejection head 3, first flow path members 50 and a second flow path member 60 constitute a flow path constitution member 210 and the flow path constitution member 210 is combined with a plurality of ejection modules 200 into a liquid ejection unit 300. A cover member 130 is attached to the surface of the liquid ejection unit 300 on the side of a recording medium. The cover member 130 has a picture frame-like surface provided with a long opening 131 and the opening 131 is formed to expose the recording element substrate 10 and a sealing material 109 thereof (refer to FIGS. 9A and 9B) included in the ejection module 200. The frame portion around the opening 131 has a function as an abutting surface of a cap member which caps the surface of the liquid ejection head 3 having an ejection orifice at the time of recording standby. It is therefore preferred to apply an adhesive, a sealing material, a filler material or the like along the periphery of the opening 131 to fill the irregularities or gap on the ejection orifice formation surface of the liquid ejection unit 300 and thereby forming a closed space at the time of capping.

Further, the liquid ejection head 3 is equipped with liquid supply units 220 positioned at both ends of the head in the longitudinal direction, respectively, negative pressure control units 230 provided for the liquid supply units 220, respectively, two liquid ejection unit support units 81, and the above-described electric wiring substrate 90. In this liquid ejection head 3, the rigidity of the head is mainly secured by the second flow path member 60. The second flow path member 60 corresponds to a common support member. The liquid ejection unit support unit 81 is connected to both ends of the second flow path member 60. It is mechanically combined with the carriage of the recording apparatus 1000 and locates the liquid ejection head 3. The liquid supply units 220 each equipped with the negative pressure control unit 230 are combined with the liquid ejection unit support unit 81 while sandwiching a joint rubber 100 therebetween and the electric wiring substrate 90 is also combined with the liquid ejection unit support unit 81. Two liquid supply units 220 have therein a filter (not shown).

The negative pressure control units 230 are each equipped with a pressure regulating mechanism and capable of drastically attenuating a pressure loss change in the supply system (that is, upstream side) of the recording apparatus 1000 which occurs with variation in the flow rate of the liquid due to the action of a valve, a spring member, or the like provided inside each of the units. The negative pressure control units 230 can stabilize a change in negative pressure on the side of the liquid ejection unit 300 (that is, on the downstream side) with respect to the negative pressure control units 230 to fall within a certain range. These two negative pressure control units 230 are set to control the pressure by respectively different negative pressures, that is, higher and lower negative pressures. When as shown in the drawing, high-pressure side and low-pressure side negative pressure control units 230 are placed at both ends of the liquid ejection head 3 in the longitudinal direction, respectively, respective liquid flows in the common supply flow path 211 and the common collection flow path 212 extending in the longitudinal direction of the liquid ejection head 3 are opposite to each other. This makes it possible to accelerate thermal exchange between the common supply flow path 211 and the common collection flow path 212 and reduce a temperature difference in the common flow path. This leads to an advantage that the recording element substrates 10 provided along the common supply flow path 211 and the common collection flow path 212 do not easily have a temperature difference and uneven recording due to the temperature difference can be prevented.

Next, the flow path constitution member 210 of the liquid ejection unit 300 will be described in detail. As shown in FIG. 5, the flow path constitution member 210 is a stack of the first flow path members 50 and the second flow path member 60 and it distributes a liquid such as recording liquid supplied from the liquid supply unit 220 to each of the ejection modules 200. The flow path constitution member 210 functions as a collection flow path member for returning the liquid coming back from the ejection module 200 to the liquid supply unit 220. The second flow path member 60 of the flow path constitution member 210 has therein the common supply flow path 211 and the common collection flow path 212 and has a function of mainly bearing the rigidity of the liquid ejection head 3. The material of the second flow path member 60 therefore preferably has sufficient corrosion resistance against a liquid such as recording liquid and high mechanical strength. More specifically, stainless steel, titanium (Ti), alumina, or the like is preferred. On the other hand, the first flow path members 50 are each preferably made of a material having a low thermal conductivity such as resin material. Setting the thermal conductivity of the first flow path members 50 low can prevent the heat generated from each of the recording element substrates 10 at the time of driving the liquid ejection head 3 from spreading to the common collection flow path 212 in the second flow path member 60 and elevating the temperature of the recording element substrate 10 on the downstream side. As a result, even when the liquid ejection head 3 has a long length, a temperature difference between the recording element substrates 10 can be decreased and recording unevenness in a recording width direction can be reduced.

Figure 6A:
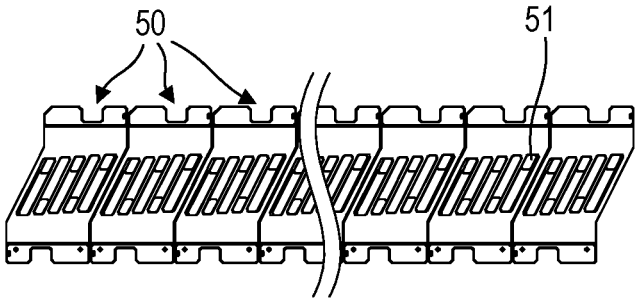
FIGS. 6A, 6B, 6C, 6D and 6E are views showing the constitution of the surface and the back surface of each flow path member.
Figure 6B:
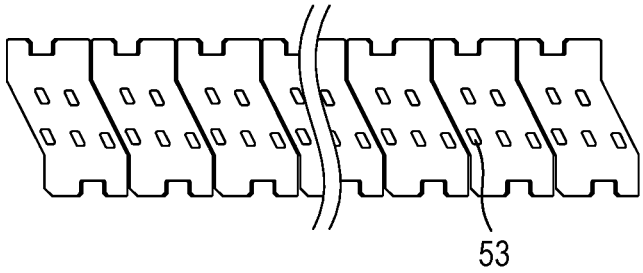
Figure 6C:
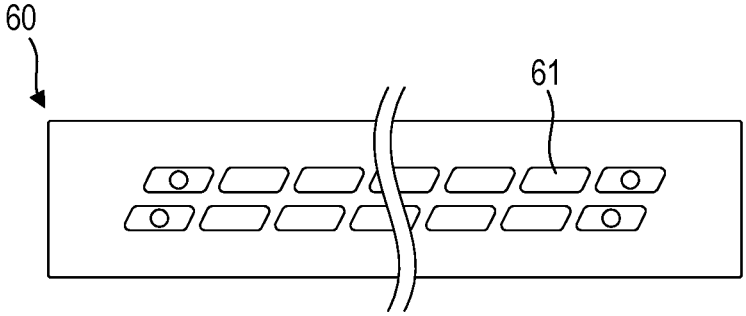
Figure 6D:
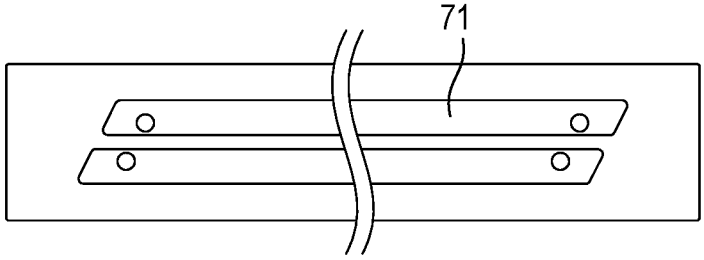
Figure 6E:
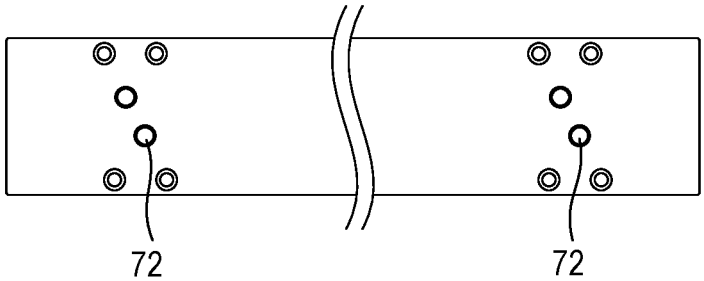

Next, the first flow path members 50 and the second flow path member 60 will be described in detail referring to FIGS. 6A to 6E. FIG. 6A shows the surface of the first flow path members 50 on the side to which the ejection module 200 is attached and FIG. 6B is the back surface thereof, that is, a surface on the side to be brought into contact with the second flow path member 60. The respective first flow path members 50 for the ejection modules 200 are arranged to be adjacent to each other. Since such a divided structure is adopted and a plurality of such modules is arranged, a liquid ejection head 3 having a demanded length can be obtained. This constitution can be particularly preferably applied to a relatively long liquid ejection head having a length corresponding to, for example, sizes equal to JIS (Japanese Industrial Standards) B2 size or more. As shown in FIG. 6A, a communication port 51 of the first flow path members 50 is fluidly communicated with the ejection module 200 and as shown in FIG. 6B, an individual communication port 53 of the first flow path members 50 is fluidly communicated with a communication port 61 of the second flow path member 60. FIG. 6C shows the surface of the second flow path member 60 on the side to be brought into contact with the first flow path members 50, FIG. 6D shows the cross-section of the second flow path member 60 at the center portion thereof in the thickness direction and FIG. 6E shows the surface of the second flow path member 60 on the side to be brought into contact with the liquid supply unit 220. The communication ports 72 shown in FIG. 6E are each communicated with the negative pressure control unit 230 via the joint rubber 100 shown in FIG. 5. The recording liquid is supplied to the second flow path member 60 from one of the communication ports 72 and discharged from the other communication port 72. One of common flow path grooves 71 of the second flow path member 60 is a common supply flow path 211 shown in FIG. 7 and the other one is a common collection flow path 212. They each supply the liquid from one of the ends to the other end along the longitudinal direction of the liquid ejection head 3. Here, the liquid flowing direction in the common supply flow path 211 and that in the common collection flow path 212 are contrary to each other along the longitudinal direction of the liquid ejection head 3.

Figure 7:
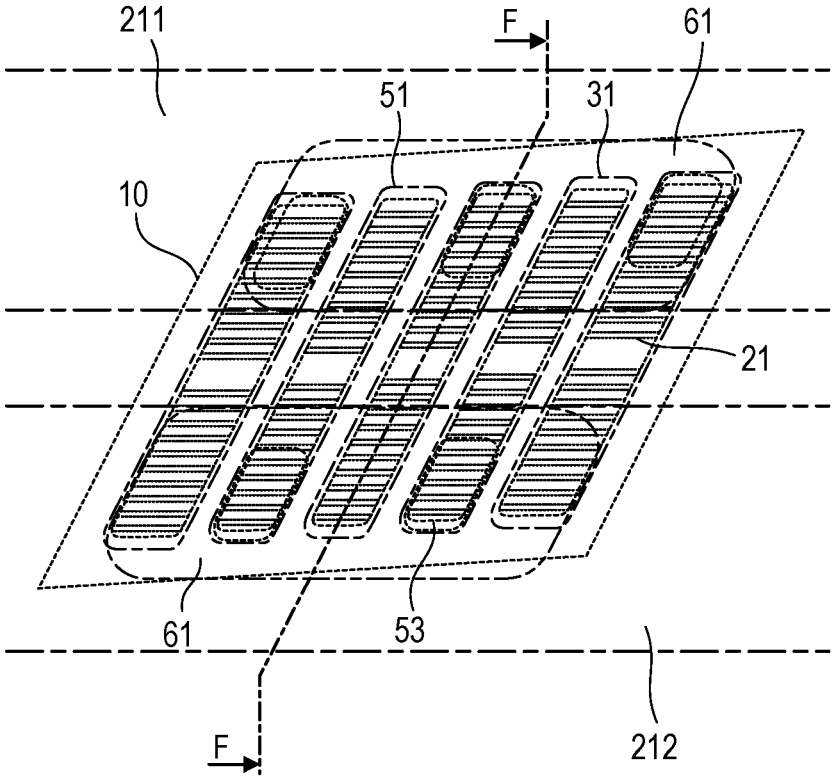
FIG. 7 is a transparent view showing the connection relationship among flow paths.

FIG. 7 shows the relationship of the connection of each flow path between the recording element substrate 10 and the flow path constitution member 210. As shown in FIG. 7, the flow path constitution member 210 has therein a pair of the common supply flow path 211 and the common collection flow path 212 extending in the longitudinal direction of the liquid ejection head 3. The communication port 61 of the second flow path member 60 is connected to an individual communication port 53 of each of the first flow path members 50 after registration and thus, a liquid supply route communicated from the communication port 72 of the second flow path member 60 to the communication port 51 of the first flow path members 50 via the common supply flow path 211 is formed. Similarly, a liquid supply route communicated from the communication port 72 of the second flow path member 60 to the communication port 51 of the first flow path members 50 via the common collection flow path 212 is formed.

Figure 8:
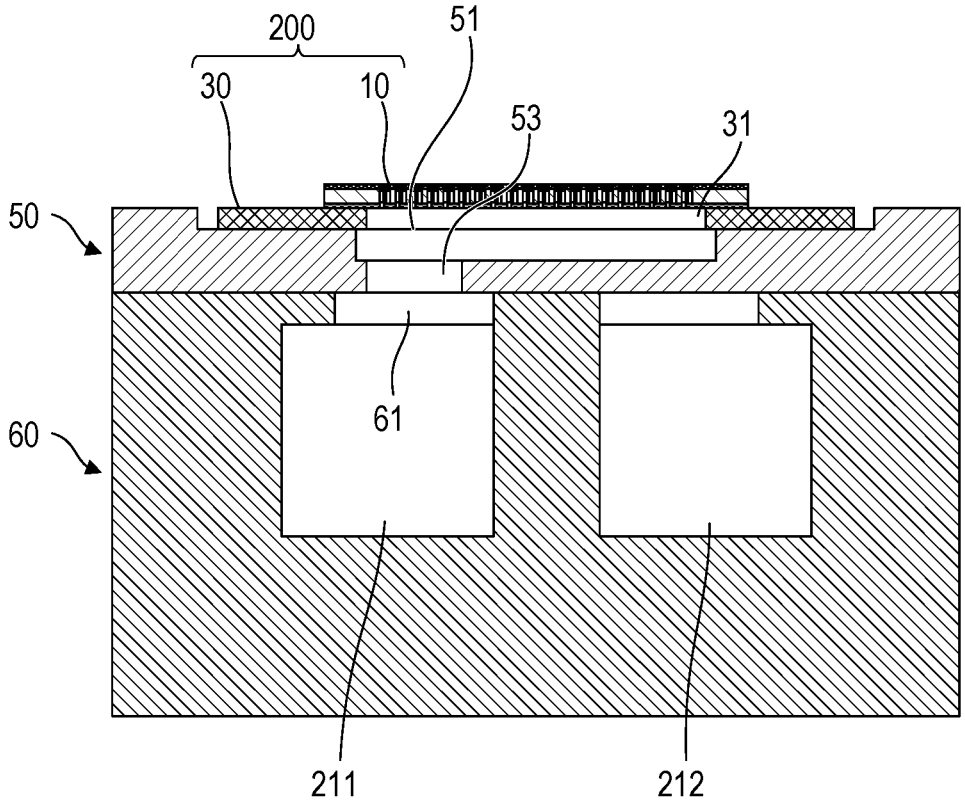
FIG. 8 is a cross-sectional view showing a flow path constitution member and an ejection module.

FIG. 8 shows the cross-section taken along the line F-F of FIG. 7. As shown in this drawing, the common supply flow path 211 is connected to the ejection module 200 via the communication port 61, individual communication port 53 and communication port 51. Although not shown in FIG. 8, it is apparent when referring to FIG. 7 that in another cross-section, the common collection flow path 212 is connected to the ejection module 200 through a similar route. Each ejection module 200 and each recording element substrate 10 have a flow path which is a formation site of each ejection orifice 13 (refer to FIGS. 11A and 11B) and is communicated with a pressure chamber 23 (refer to FIGS. 11A and 11B). This flow path enables a portion or whole of a supplied liquid to pass the pressure chamber 23 corresponding to the ejection orifice 13 that has suspended its ejection operation to come back. The common supply flow path 211 and the common collection flow path 212 are connected to the high-pressure side negative pressure control unit 230 and the low-pressure side negative pressure control unit 230, respectively, via the liquid supply unit 220. Due to a pressure difference derived from these negative pressure control units 230, there occurs a flow starting from the common supply flow path 211, passing through the pressure chamber 23 of the recording element substrate 10, and reaching the common collection flow path 212.

Description of Ejection Module

Figure 9A:
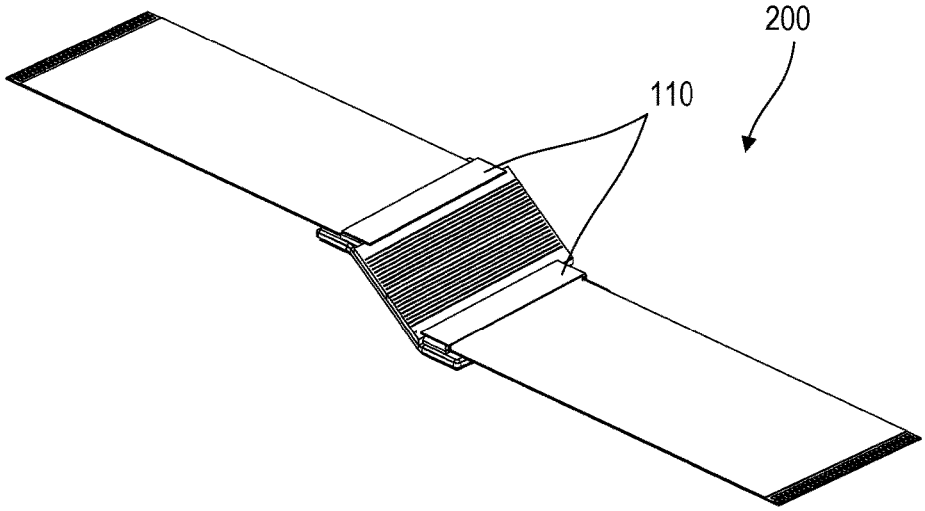
FIGS. 9A and 9B are each an explanatory view of an ejection module.
Figure 9B:
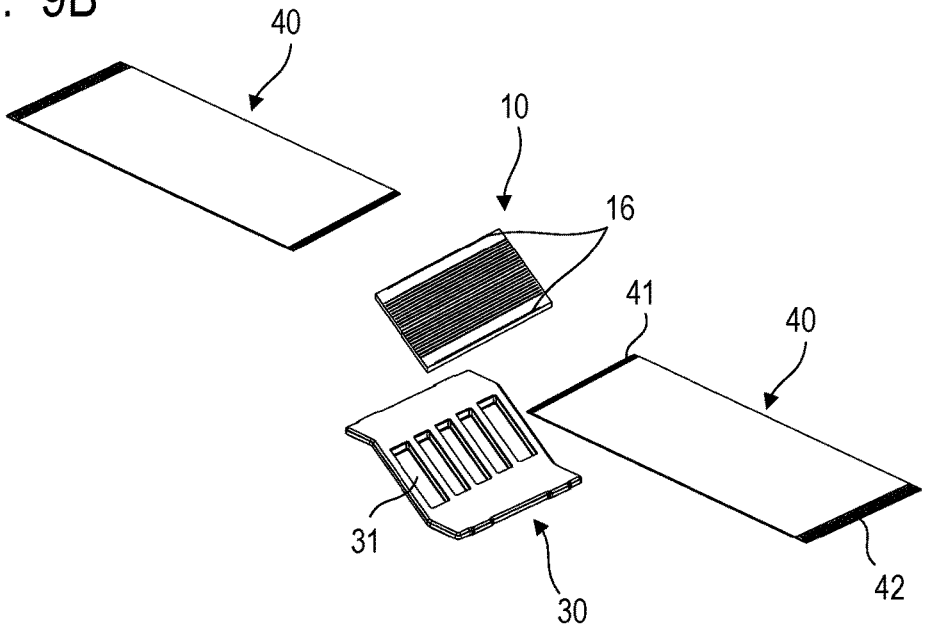

One example of the constitution of the ejection module 200 will next be described. FIG. 9A is a perspective view of the ejection module 200 and FIG. 9B is an exploded view thereof. In the ejection module 200, a support member 30 has thereon the recording element substrate 10. The recording element substrate 10 has, at both sides thereof along the ejection orifice row direction, that is, at the long side portion of the recording element substrate 10, a plurality of terminals 16 (refer to FIGS. 10A to 10C) and a flexible wiring substrate 40 is electrically connected to these terminals 16. This means that two flexible wiring substrates 40 are placed for one recording element substrate 10. Such a structure is adopted because since the number of ejection orifice rows provided per recording element substrate 10 is as many as 20, the maximum distance from the terminal 16 to the recording element 15 (refer to FIGS. 11A and 11B) is made smaller to reduce a voltage drop or signal transmission lag generated at a wiring unit in the recording element substrate 10. This ejection module 200 is manufactured in the following manner. First, a recording element substrate 10 and a flexible wiring substrate 40 are bonded onto a support member 30 having a liquid communication port 31 provided in advance. Then, a terminal 16 on the recording element substrate 10 and a terminal 41 on the flexible wiring substrate 40 are electrically connected to each other by wire bonding, followed by covering and sealing a wiring bonding unit (electrical connection unit) with a sealing member 110. A terminal 42 on the side opposite to the recording element substrate 10 of each of the flexible wiring substrates 40 is electrically connected to a connection terminal 93 of an electric wiring substrate 90 (refer to FIG. 5).

The support member 30 is a supporter for supporting the recording element substrate 10 and also a flow path communication member for fluidly communicating the recording element substrate 10 with the flow path constitution member 210. The liquid communication port 31 of the support member 30 is opened so as to stride over all the ejection orifice rows which the recording element substrate 10 has. The support member 30 having high flatness and capable of being joined with the recording element substrate 10 and the first flow path member 50 with adequately high reliability is therefore preferred. From this standpoint, the flatness of the joint surface of the support member 30 is preferably higher than the flatness of the first flow path member 50. More specifically, the flatness of the joint surface of the support member 30 with the recording element substrate 10 is preferably higher than the flatness of the joint surface of the first flow path member 50 with the support member 30. As the material of the support member 30, ceramics such as alumina or resin materials are preferred. Of these, high thermal conductivity materials such as alumina are preferably used from the thermal standpoint. The high thermal conductivity materials are preferred because use of them brings an effect as a soaking board for the recording element substrate 10. In addition, the support member 30 having a high thermal conductivity can spread a heat transfer area from the recording element substrate 10 to the first flow path member 50 and thereby also produce an effect as a heat spreader. As a result, the temperature of the recording element substrate 10 can be reduced. Use of ceramics such as alumina as the support member 30 facilitates increasing the flatness of the joint surface with the recording element substrate 10 by polishing. This makes it possible to decrease the application thickness of an adhesive for bonding the recording element substrate 10 to the support member 30 and reduce the projection of the adhesive to the flow path.

Description of Structure of Recording Element Substrate

Figure 10A:
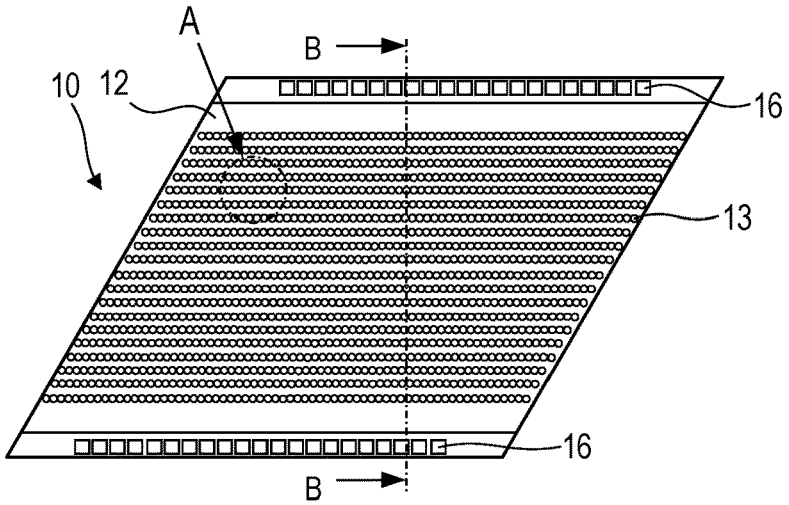
FIGS. 10A, 10B and 10C are views showing the constitution of a recording element substrate.
Figure 10B:
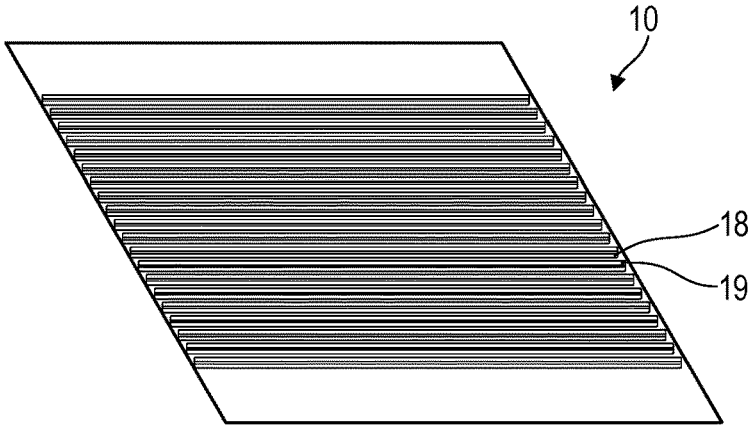
Figure 10C:
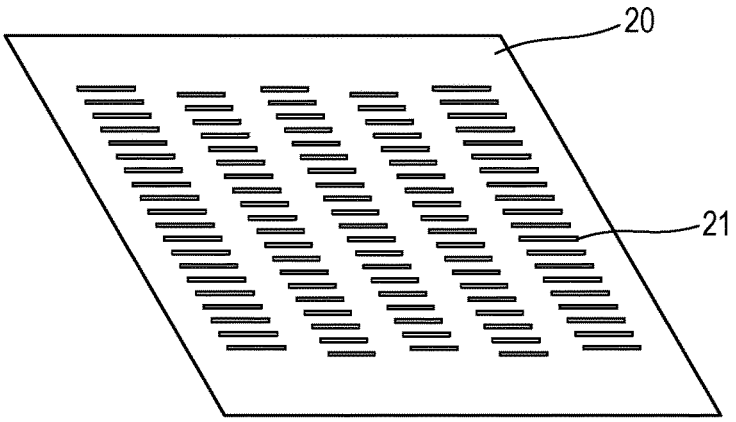
Figure 11A:
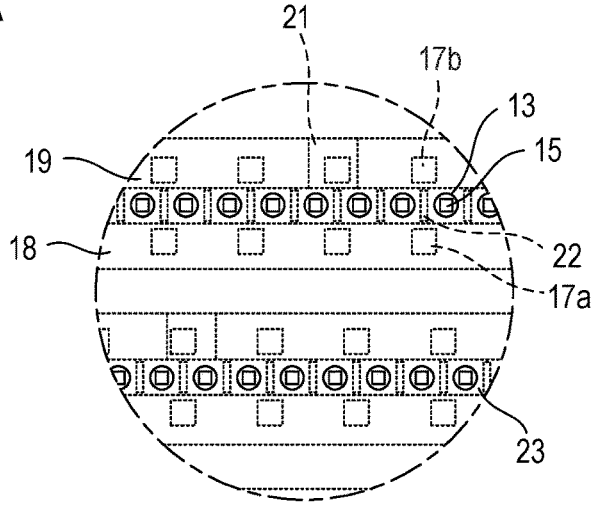
FIGS. 11A and 11B are views showing the constitution of a recording element substrate.

Next, the constitution of the recording element substrate 10 will be described referring to FIGS. 10A to 10C and FIGS. 11A and 11B. FIG. 10A is a plan view of the surface of the recording element substrate 10 on the side where the ejection orifice 13 is to be formed; FIG. 10B shows a portion having a liquid supply path 18 and a liquid collection path 19 and FIG. 10C is a plan view on the side corresponding to the back surface of FIG. 10A. FIG. 10B does not have a lid member 20 provided on the back surface side of the recording element substrate 10 in FIG. 10C. FIG. 11A is an enlarged view of a portion shown by A in FIG. 10A and FIG. 11B shows the cross-section of the recording element substrate 10 and the lid member 20 on the surface B-B in FIG. 10A.

Figure 11B:
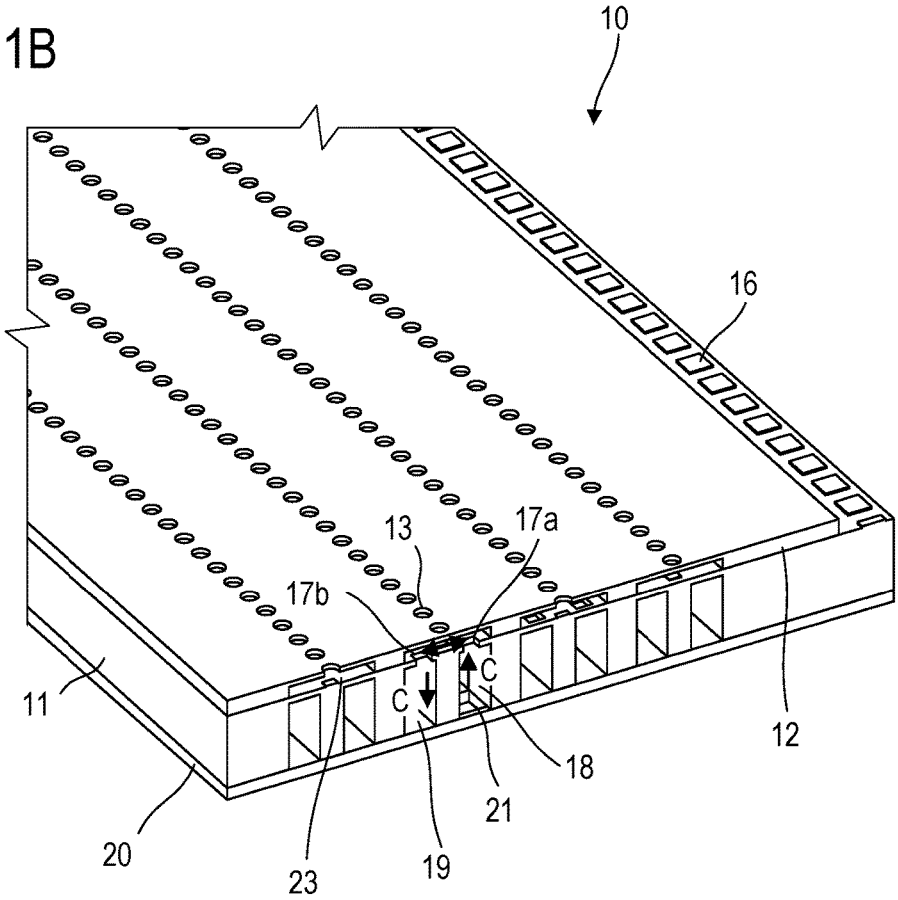

As shown in FIG. 11B, the recording element substrate 10 is obtained by stacking an ejection orifice formation member 12 made of a photosensitive resin on one of the surfaces of a substrate 11 made of silicon (Si) and stacking a sheet-like lid member 20 on the other surface. As shown in FIG. 10A, the ejection orifice formation member 12 has a plurality of ejection orifices 13 in row and here, 20 rows of ejection orifices are provided. As shown in FIG. 11A, the substrate 11 has, on one of the surfaces thereof and at a position corresponding to each of the ejection orifices 13, a recording element 15 which is a heater element for foaming the liquid by thermal energy. The pressure chamber 23 having the recording element 15 inside thereof is defined by a partition 22 formed by the ejection orifice formation member 12. The recording element 15 is electrically connected to a terminal 16 shown in FIG. 10A through electric wiring (not shown) provided on the recording element substrate 10. The recording element 15 generates heat based on pulse signals input from the control circuit of the recording apparatus 1000 via the electric wiring substrate 90 (FIG. 5) and the flexible wiring substrate 40 (FIGS. 9A and 9B), boils the liquid in the pressure chamber 23 and ejects the liquid from the ejection orifice 13 by the foaming force caused by this boiling. The substrate 11 has, on the other surface side, grooves constituting the liquid supply path 18 and the liquid collection path 19 as shown in FIG. 10B. As shown in FIG. 11A, the liquid supply path 18 and the liquid collection path 19 are provided for each ejection orifice row so that the liquid supply path 18 extends on one side and the liquid collection path 19 extends on the other side, each along this ejection orifice row. The liquid supply path 18 and the liquid collection path 19 are communicated with the ejection orifices 13 via a supply port 17*a* and a collection port 17*b*, respectively.

The lid members 20 is provided with a plurality of openings 21 communicated with the liquid supply path 18 and the liquid collection path 19. In the present embodiment, the lid member 20 is provided with three rows of openings 21 for one liquid supply path 18 and two rows of openings for one liquid collection path 19. As is shown in FIG. 11B, the lid member 20 functions as a lid constituting a portion of the wall of the liquid supply path 18 and the liquid collection path 19 formed in the substrate 11 of the recording element substrate 10. The opening 21 of the lid member 20 is communicated with the liquid communication port 31 shown in FIG. 8 or FIG. 9B. The lid member 20 is preferably made of a material having sufficient corrosion resistance against a liquid to be ejected. From the standpoint of preventing leakage between the liquid supply path 18 and the liquid collection path 19, the shape and the position of the opening 21 are required have high accuracy. It is therefore preferred to use, as a material of the lid member 20, a photosensitive resin material or a silicon plate and provide the opening 21 by a photolithography process. Thus, the lid member serves to change the pitch of the flow path by making use of the opening 21 and in consideration of a pressure loss, it is preferably thin and is preferably a film-like member.

Next, the flow of a liquid in the recording element substrate 10 will be described. The liquid supply path 18 and the liquid collection path 19 formed from the substrate 11 and the lid member 20 are connected to the common supply flow path 211 and the common collection flow path 212 in the flow path constitution member 210, respectively, and a pressure difference is caused between the liquid supply path 18 and the liquid collection path 19. With respect to the ejection orifice 13 not engaged in ejection operation during recording with the liquid ejected from a plurality of ejection orifices 13, the liquid in the liquid supply path 18 passes the supply port 17*a*, the pressure chamber 23 and the collection port 17*b* and flows to the liquid collection path 19 due to the above-described pressure difference. This flow is indicated by an arrow C in FIG. 11B. By this flow, thickened ink, bubbles or foreign matter which have generated in the ejection orifice 13 that has suspended its recording operation or in the pressure chamber 23 as a result of evaporation of the liquid from in the ejection orifice 13 can be collected into the liquid collection path 19. In addition, an increase in the viscosity of the recording liquid in the ejection orifice 13 or pressure chamber 23 can be suppressed. The liquid collected in the liquid collection path 19 is collected successively in the communication port 51, the individual collection flow path 214, and the common collection flow path 212 in the flow path constitution member 210 through the opening 21 of the lid member 20 and the liquid communication port 31 of the support member 30 (refer to FIG. 9B). The liquid thus collected is finally collected in the supply route of the recording apparatus 1000.

In short, in the liquid ejection head 3 of the present embodiment, a liquid such as recording liquid supplied from the main body of the recording apparatus 1000 to the liquid ejection head 3 flows, is supplied, and is collected in the following order. First, the liquid flows from the liquid connection unit 111 of the liquid supply unit 220 into the liquid ejection head 3. This liquid is supplied successively to the joint rubber 100, the communication port 72, the common flow path groove 71 and the communication port 61 each provided in the second flow path member 60, and the individual communication port 53, an individual flow path groove 52 and the communication port 51 each provided in the first flow path member 50. Then, the liquid is supplied to the pressure chamber 23 after successively passing the liquid communication port 31 provided in the support member 30, the opening 21 provided in the lid member, and the liquid supply path 18 and the supply port 17*a* each provided in the substrate 11. Of the liquid supplied to the pressure chamber 23, a portion of the liquid not ejected from the ejection orifice 13 successively flows through the collection port 17*b* and the liquid collection path 19 each provided in the substrate 11, the opening 21 provided in the lid member 20, and the liquid communication port 31 provided in the support member 30. Then, the liquid successively flows through the communication port 51, the individual flow path groove 52 and the individual communication port 53 each provided in the first flow path member 50, the communication port 61, the common flow path groove 71 and the communication port 72 provided in the second flow path member 60 and the joint rubber 100. The liquid flows from the liquid connection unit 111 provided in the liquid supply unit 220 to the outside of the liquid ejection head 3. When the first circulation form shown in FIG. 2 is adopted, the liquid which has entered from the liquid connection unit 111 passes the negative pressure control unit 230 and is then supplied to the joint rubber 100. On the other hand, when the second circulation type shown in FIG. 3 is adopted, the liquid collected from the pressure chamber 23 passes the joint rubber 100 and then flows from the liquid connection unit 111 to the outside of the liquid ejection head 3 via the negative pressure control unit 230.

All the liquid that has flown from one end of the common supply flow path 211 of the liquid ejection unit 300 is not supplied to the pressure chamber 23 after passing the individual supply flow path 213*a*. As shown in FIGS. 2 and 3, some portion of the liquid flows from the other end of the common supply flow path 211 to the liquid supply unit 220 without flowing into the individual supply flow path 213*a*. Thus, even when the recording element substrate 10 has a minute flow path having large flow resistance, a reverse flow of a circulation flow of the liquid can be suppressed by providing a route in which the liquid flows without passing the recording element substrate 10. Thus, in the liquid ejection head 3, since thickening of the liquid in the vicinity of the pressure chamber or the ejection orifice can be suppressed, non-straight ink ejection or ejection failure can be suppressed and as a result, recording with high image quality can be performed.

Description of Positional Relationship Between Recording Element Substrates

Figure 12:
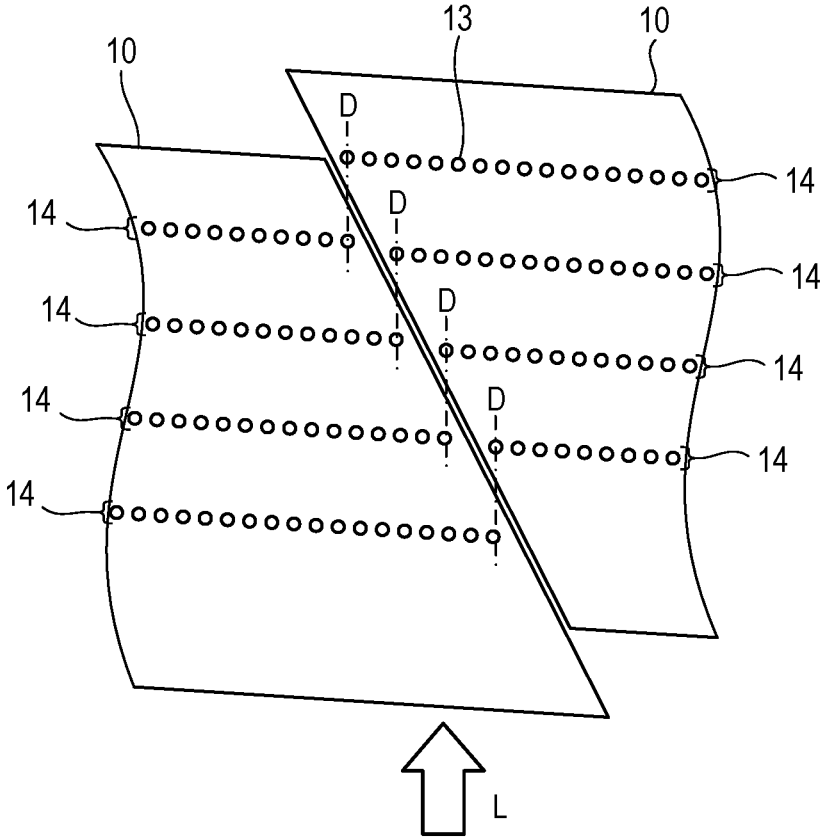
FIG. 12 is a plan view showing recording element substrates adjacent to each other.

As described above, the liquid ejection head 3 is equipped with a plurality of ejection modules 200. FIG. 12 shows a partially enlarged view of an adjacent portion of the recording element substrates 10 in two ejection modules 200 adjacent to each other. As shown in FIGS. 10A to 10C, the recording element substrates 10 used have roughly a parallelogram shape. For description, FIG. 12 shows four ejection orifice rows 14 in each of the recording element substrates 10. In each of the recording element substrates 10, each of the ejection orifice rows 14 in which ejection orifices 13 are arranged is inclined at a predetermined angle to the conveying direction L of the recording medium. In another viewpoint, a plurality of ejection modules 200 is arranged in a straight line along the longitudinal direction of the liquid ejection head and the ejection orifice rows 14 of each of the recording element substrates 10 are inclined at an acute angle to the longitudinal direction of the liquid ejection head. At least one of the ejection orifices 13 in the ejection orifice rows 14 at the adjacent portion in one of the two recording element substrates 10 adjacent to each other overlaps, in the conveying direction L of the recording medium, with that at the adjacent portion in the other recording element substrate. In FIG. 12, two ejection orifices 13 on line D overlap with each other. By such arrangement, even when one of the ejection orifices 13 fails to eject, it can be compensated by an ejection orifice 13 of another ejection orifice row 14. In addition, by driving ejection so as to distribute and stride over some of the ejection orifice rows 14, recording can be performed while averaging the variation in volume of ejected droplets derived from fabrication tolerance of each of the ejection orifices 13 and unevenness in recording images can be made inconspicuous. Further, even when the position of the recording element substrate 10 slightly deviates from a predetermined position, driving control of the ejection orifices 13 overlapping with each other can make black stripes or blank portions in the recorded image inconspicuous. The shape profile of the recording element substrate 10 here is roughly parallelogram, but it is not limited thereto. Even when a recording element substrate 10 having another shape such as rectangle or trapezoid is used, the constitution of the invention can be preferably applied thereto.

As described above, in the present embodiment, a plurality of recording element substrates 10 is arranged in almost a line (in an almost straight line) in the width direction of the recording medium while bringing them close to each other. Such arrangement may be called "in-line arrangement". In the in-line arrangement, a distance between ejection orifice rows 14 at the overlap portion of the recording element substrates 10 is shorter than that in the zigzag arrangement of the recording element substrates 10 so that ejected liquid droplets reach the recording medium with a reduced time lag. This arrangement brings an advantage that a high quality recorded image with reduced color unevenness can be formed at high speed. The ejection orifice face is, however, wiped with a wiper blade for cleaning or the like and in this case, a distance between the recording element substrates 10 is small so that a difference in height (step difference) of the ejection orifice face between the recording element substrates 10 adjacent to each other should be decreased. When a step difference of the ejection orifice face between the recording element substrates 10 adjacent to each other is large, on the other hand, a region of the recording element substrate 10 in the vicinity of the end portion of the ejection orifice row 14 fails to touch the wiper blade. In addition to this problem, another problem occurs; that is, when a height difference of the ejection orifice face is large, the wiper blade is easily damaged by contact with the corner portion of the recording element substrate 10, which increases exchange frequency of the wiper blade.

In the present embodiment, in order to reduce a step difference of an ejection orifice face among the recording element substrates 10 adjacent to each other, the liquid ejection head 3 is fabricated by a method as described below. The second flow path member 60 is, as a common support member, a single member extending in the longitudinal direction of the liquid ejection head 3, while the first flow path member 50 and the ejection module 200 are provided for each of the recording element substrates 10. In order to reduce a step difference between the ejection orifice faces, it is necessary to set appropriately a distance between the second flow path member 60 and the ejection orifice face of each of the recording element substrates 10. A step of joining the first flow path member 50 and the ejection module 200 (support member 30 and recording element substrate 10) with the second flow path member 60 to form the liquid ejection unit 300 will hereinafter be described. In the following description, adhesion while bringing surfaces of two members to be joined into partial contact with each other at the time of joining these two members with an adhesive will hereinafter be called "abutting adhesion". Adhesion of the surfaces to be joined while having an adhesive layer formed completely therebetween and preventing direct contact will be called "floating adhesion".

Manufacturing Steps of the First Embodiment

Figure 13A:
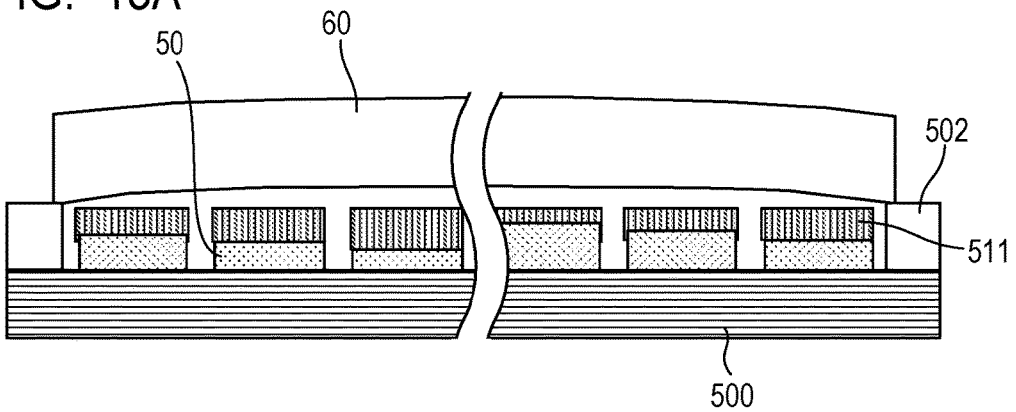
FIGS. 13A, 13B and 13C are schematic views showing steps of manufacturing an ejection unit according to a First Embodiment.
Figure 13B:
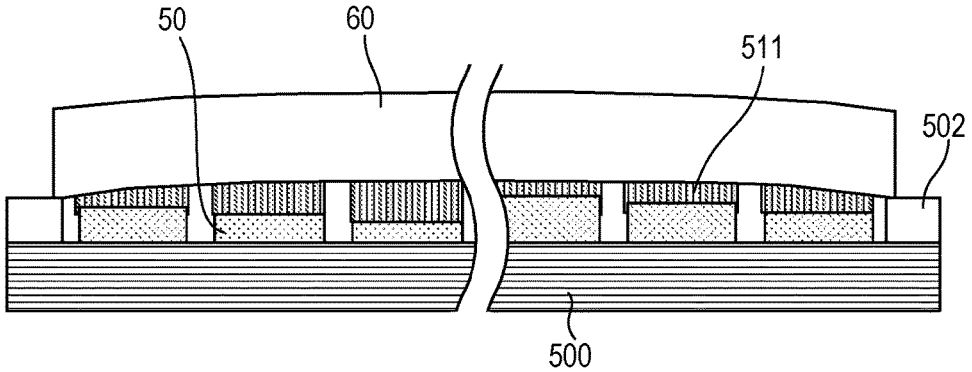
Figure 13C:
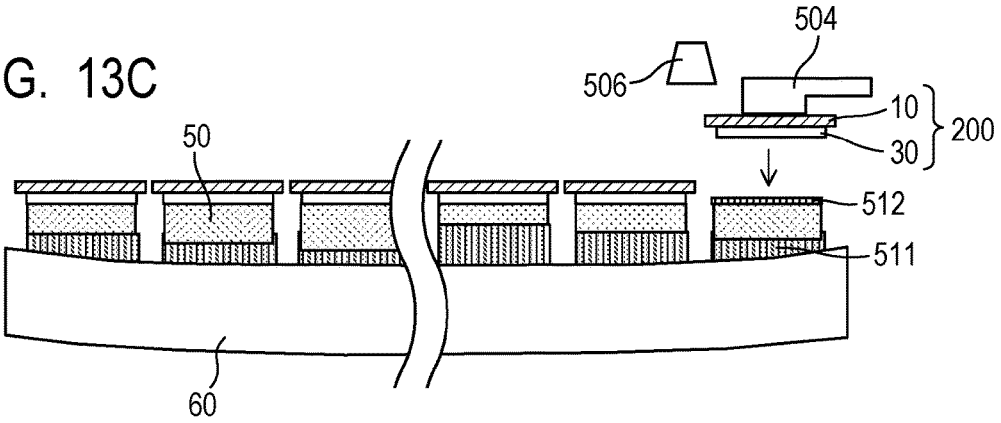

FIGS. 13A to 13C are schematic views successively showing steps of joining members with an adhesive to form a liquid ejection unit 300 in the First Embodiment. To facilitate understanding of them, an electric connection member such as flexible wiring substrate 40 is omitted from FIGS. 13A to 13C. The adhesive has usually a thickness of from several tens of μm to several hundreds of μm and is markedly thinner than flow path members 50 and 60. In the drawings, however, an adhesive intentionally made thicker is shown to facilitate understanding. The warpage of the second flow path member 60 is also made larger intentionally. The manufacturing steps will hereinafter be described in detail.

As a step (a), a certain number of first flow path members 50 to be included in one liquid ejection head 3 are arranged side by side at predetermined positions on a stage 500 having high flatness. At this time, the first flow path members 50 are arranged so that the joint surface of these first flow path members 50 with the ejection module 200 comes in the downward vertical direction. The arrangement is performed with the surface to be joined with the second flow path member 60 up so that an adhesive 511 is applied to this surface. As described above, the individual communication port 53 of the first flow path members 50 is fluidly communicated with the communication port 61 of the second flow path member 60 so that the first flow path members 50 and the second flow path member 60 have therein an opening for the flow path. The adhesive 511 is not applied to a region of the opening for the flow path. Here, the adhesive 511 is applied to the side of the first flow path members 50 but the adhesive 511 may be applied to the joint surface of the second flow path member 60 with the first flow path members 50 or the adhesive 511 may be applied to both surfaces. The stage 500 has thereon a lifting jig 502 which rises or falls in the vertical direction to the stage 500 and sandwiches a group of the first flow path members 50 arranged. Next, the second flow path member 60 is placed on the lifting jig 502 so as to stride over the group of the first flow path members 50. At this time, the second flow path member 60 is placed on the lifting jig 502 so that a surface of it, which will be a joint surface with the first flow path members 50, faces in the downward vertical direction and at the same time, is positioned above the first flow path members 50 in the vertical direction. Although not shown in the drawing, the second flow path member 60 has, at both ends in the long direction thereof, reference portions having uniform height positions, respectively, and by butting these reference portions against a predetermined position of the lifting jig 502, the second flow path member 60 is fixed relatively to the lifting jig 502.

Next, in a step (b), as shown in FIG. 13B, the lifting jig 502 is lowered toward the stage 500 along the vertical direction and floating adhesion of all the first flow path members 50 on the stage 500 to the second flow path member 60 is performed with an adhesive 511. Variation derived from the thickness tolerance of the first flow path members 50 and the warpage tolerance of the second flow path member 60 is absorbed by a flattened amount of the adhesive 511. The thickness of the adhesive 511 to be applied is therefore preferably greater than the sum of the thickness tolerance of the first flow path members 50 and the flatness of the joint surface of the second flow path member 60 with the first flow path members 50. Here, the lifting jig 502 which is a second stage is moved while fixing the stage 500 which is a first stage and the second flow path member 60 is moved in the vertical direction. Alternatively, the first flow path members 50 may be moved in the vertical direction. When the adhesive 511 is cured under such a state, the first flow path members 50 and the second flow path member 60 are joined via an adhesive layer made of a cured adhesive 511 while preventing direct contact between them.

Next, in a step (c), a joined body of the first flow path members 50 and the second flow path member 60 obtained by performing steps up to the step (b) is placed on the stage 500 with the upside down, that is, with the second flow path member 60 down. As shown in FIG. 13C, an adhesive 512 is applied to the joint surface of each of the first flow path members 50 with the ejection module 200 and the ejection module 200 is joined with them successively by butting adhesion. Since butting adhesion is employed, the adhesive 512 cannot be seen in the cross-sectional view of FIG. 13C in the first flow path members 50 to which the ejection module 200 has been joined already. Although not shown here, in the ejection module 200, the recording element substrate 10 and the support member 30 have already been joined by butting adhesion. In this butting adhesion, the ejection module 200 is conveyed using the pickup arm 504 and the ejection module 200 is placed on the first flow path members 50 while carrying out position correction so that the variation of the position of the recording element substrate 10 in a horizontal plane becomes a desired value or less. The position correction is performed by controlling the position of the pickup arm 504 while referring to an alignment mark (not shown) on the recording element substrate 10 by a camera 506. Then, heat treatment or the like is performed to cure the adhesive 512.

The above-described steps (a) to (c) can provide a long liquid ejection head 3 having a less height difference of the ejection orifice face among the recording element substrates 10 and having high position accuracy among the recording element substrates 10 (that is, among the ejection orifices 13).

Second Embodiment

Figure 14A:
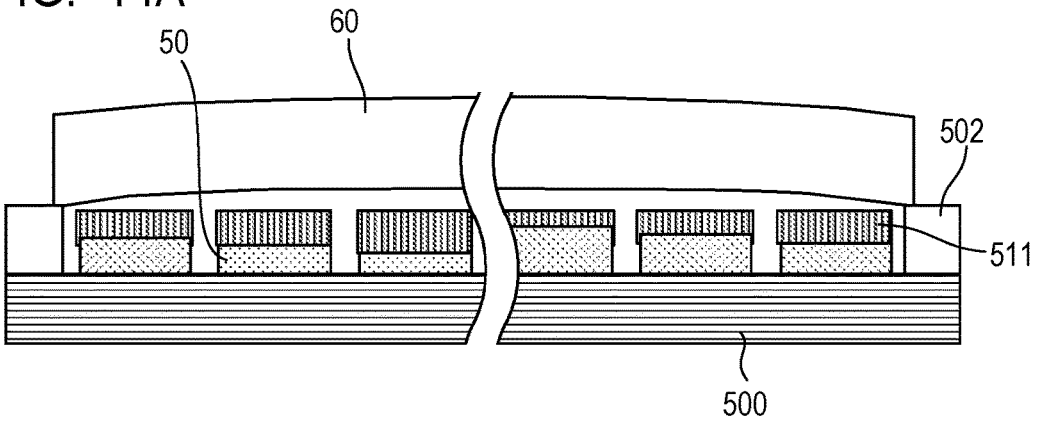
FIGS. 14A, 14B and 14C are schematic views showing steps of manufacturing an ejection unit according to a Second Embodiment.
Figure 14B:
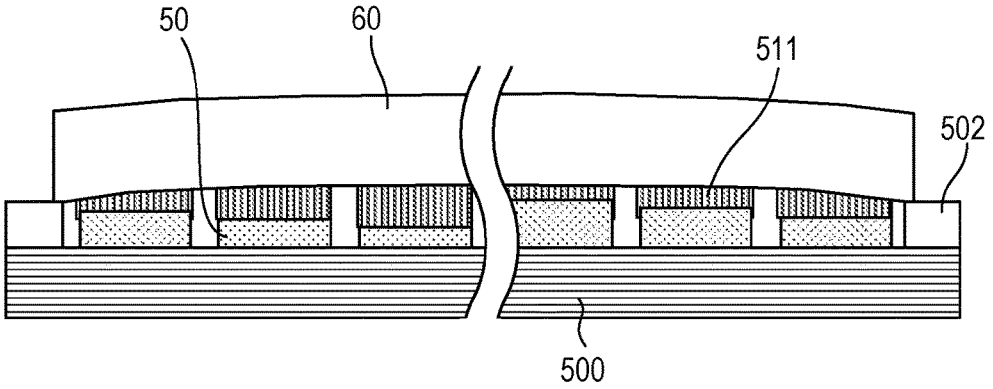
Figure 14C:
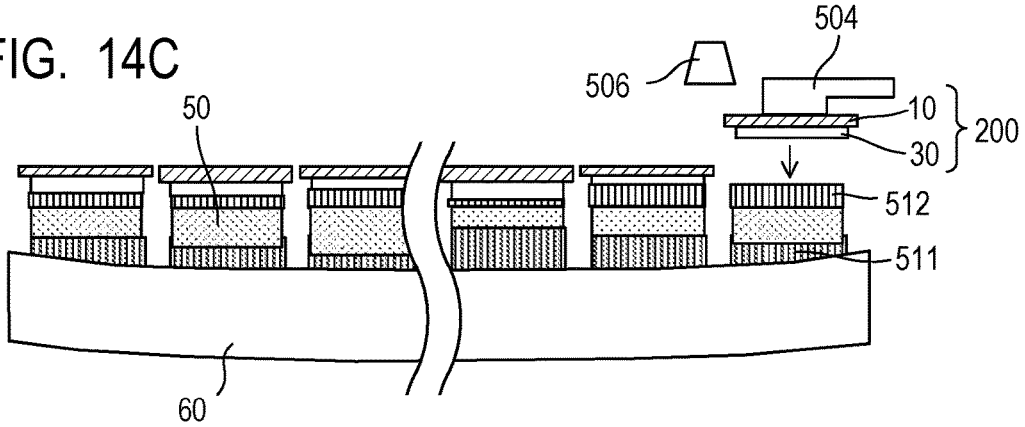

FIGS. 14A to 14C are schematic views successively showing steps of joining members with an adhesive to form a liquid ejection unit 300 in the Second Embodiment. The Second Embodiment is more preferable than the First Embodiment when the thickness tolerance of the recording element substrate 10 and the support member 30 constituting the ejection module 200 is large. FIGS. 14A and 14B show steps (a) and (b) of the present embodiment. The steps (a) and (b) of the present embodiment are similar to the steps (a) and (b) of the First Embodiment, respectively, so that description of these steps is omitted here.

In the step (c), a joined body of the first flow path members 50 with the second flow path member 60 obtained by performing steps up to the step (b) is placed on the stage 500 with the upside down. As shown in FIG. 14C, an adhesive 512 is applied thick to the joint surface of each of the first flow path members 50 with the ejection module 200 and the ejection module 200 is joined with them successively by floating adhesion. Similar to the First Embodiment, the recording element substrate 10 and the support member 30 have already been joined by butting adhesion in the ejection module 200. When floating adhesion of the ejection module 200 on the first flow path members 50 is performed, the height position of the ejection orifice face of the recording element substrate 10 is fixed by a pickup arm 504 so that it always comes to the same height. By this, variation in the position in the height direction of the ejection orifice face of the plurality of recording element substrates 10 falls within a mechanical error range of the pickup arm 504. To convey and place the ejection module 200 by means of the pickup arm 504, the position of it is corrected while referring to an arrangement mark by using a camera 506 as in the First Embodiment. This makes it possible to adjust the relative position accuracy in the horizontal plane among the recording element substrate 10 to a desired value or less. The application thickness of the adhesive 512 is required to be greater than the sum of the thickness tolerance of the ejection module 200 and the variation in height of the first flow path members 50 after being joined with the second flow path member 60 (that is, a distance of the surface on the side of the ejection module 200 from the stage).

The above-described steps (a) to (c) can provide a long liquid ejection head 3 having a less difference in height of the ejection orifice face among the recording element substrates 10 and having high position accuracy among the recording element substrates 10.

Third Embodiment

Figure 15A:
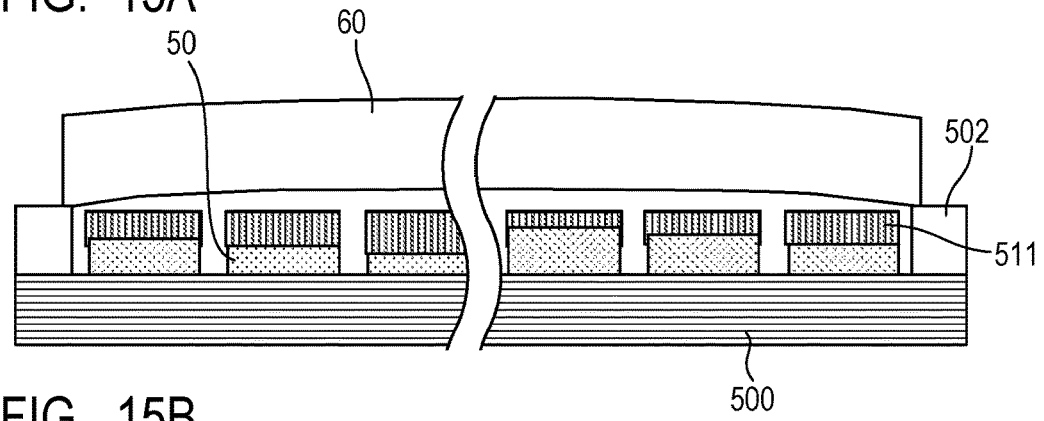
FIGS. 15A, 15B, 15C and 15D are schematic views showing steps of manufacturing an ejection unit according to a Third Embodiment.
Figure 15B:
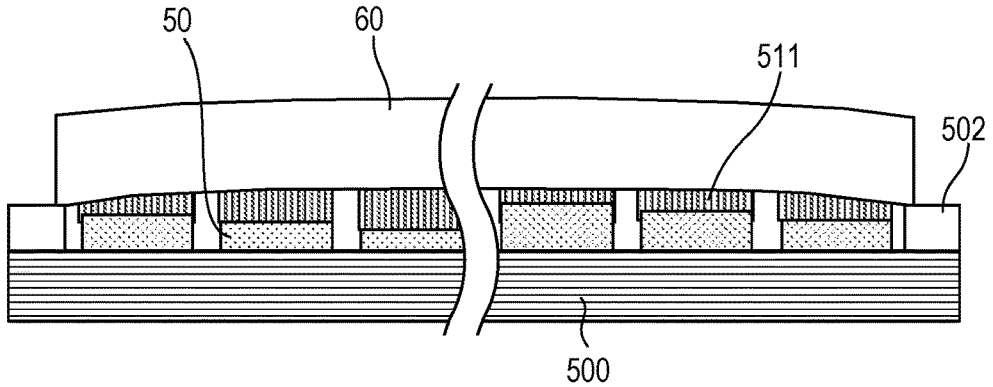

FIGS. 15A to 15D are schematic views showing steps of joining members with an adhesive to form a liquid ejection unit 300 successively in the Third Embodiment. The Third Embodiment is preferable because it can shorten a manufacturing tact in the case where the thickness tolerance of the recording element substrate 10 and the support member 30 constituting the ejection module 200 is large but variation in the height of the first flow path members 50 after being joined with the second flow path member 60 can be decreased. FIGS. 15A and 15B show steps (a) and (b) in the present embodiment, respectively. The steps (a) and (b) in the present embodiment are similar to the steps (a) and (b) in the First Embodiment, respectively, so that description on these steps is omitted here.

Figure 15C:
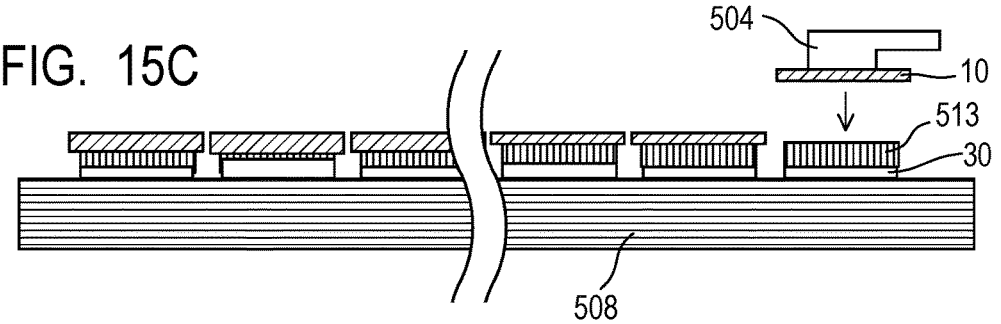
Figure 15D:
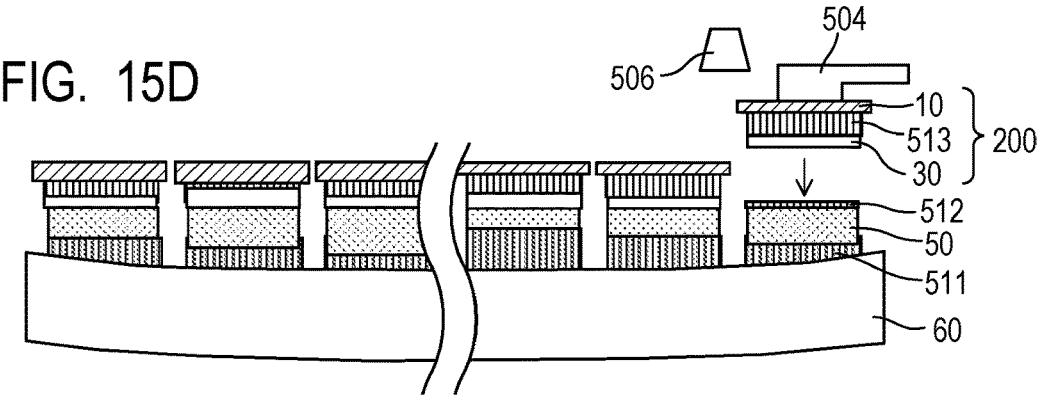
Figure 16A:
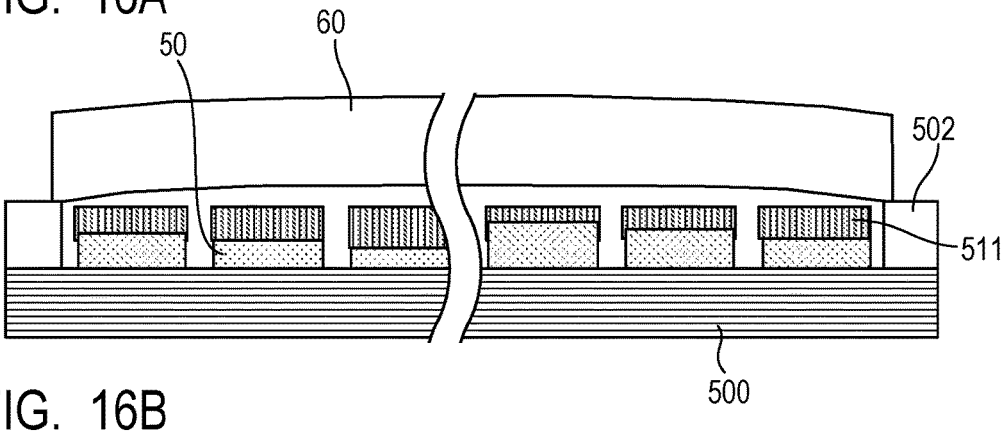
FIGS. 16A, 16B, 16C and 16D are schematic views showing steps of manufacturing an ejection unit according to a Fourth Embodiment.
Figure 16B:
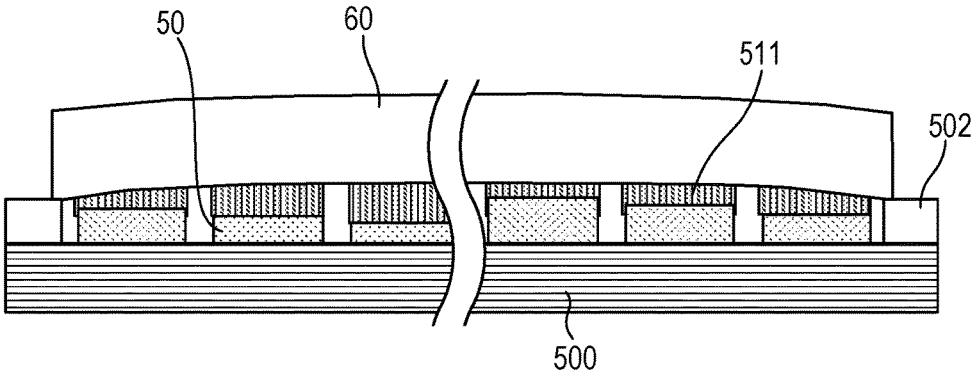
Figure 16C:
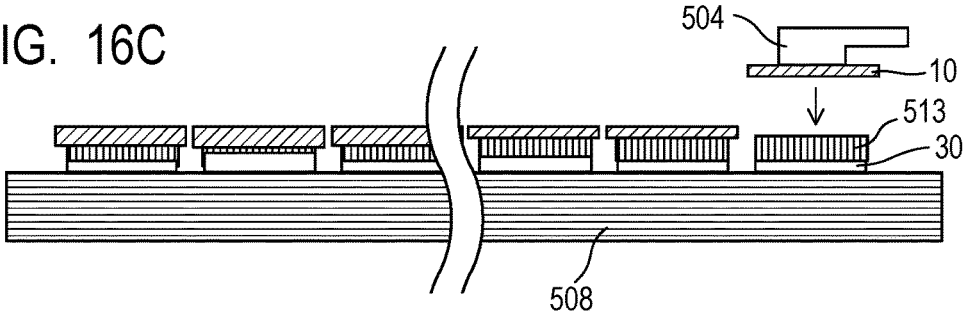
Figure 16D:
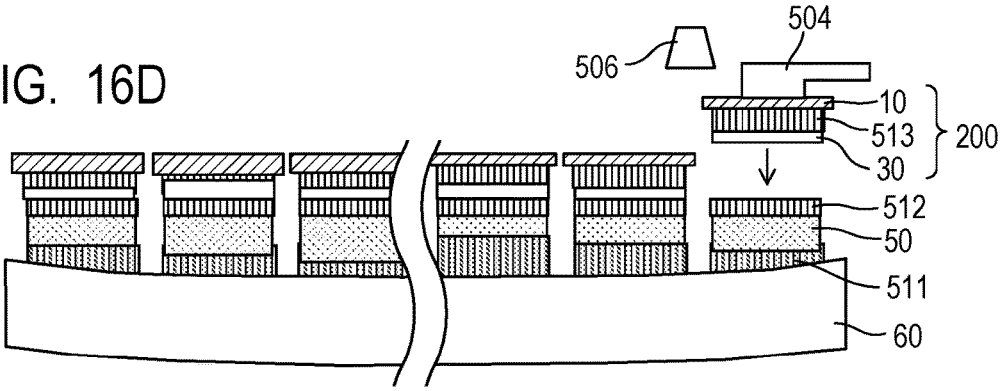

In the step (c), as shown in FIG. 15C, a plurality of support members 30 is placed on a stage 508 having high flatness to turn the joint surface with the recording element substrate 10 upward. An adhesive 513 is then applied to the joint surface of the support member 30 with the recording element substrate 10. The recording element substrate 10 is conveyed by means of a pickup arm 504 to place it on the adhesive 513 and the recording element substrate 10 is joined with the support member 30 by floating adhesion. At this time, the height position of the recording element substrate 10 is fixed by the pickup arm 504 so that the respective ejection orifice faces of the recording element substrates 10 have the same height position. Thus, manufacture of ejection modules 200 is completed. By this, variation in thickness among the ejection modules 200 thus obtained 10 falls within a mechanical error range of the pickup arm 504. The thickness of the adhesive 513 to be applied to the support member 30 is required to be greater than the sum of the thickness tolerance of the support substrate 30 and the recording element substrate 10 and the flatness of them. The step (c) may be performed in parallel with the steps (a) and (b) or may be performed before or after the steps (a) and (b). The stage 508 may be the same or different from the above-described stage 500.

In the step (d), the ejection module 200 obtained in the step (c) is joined with the joined body between the first flow path members 50 and the second flow path member 60 obtained in the step (b). At this time, the joined body between the first flow path members 50 and the second flow path member 60 is placed while turning the joint surface with the ejection module 200 upward and thus, a plurality of the ejection modules 200 is joined with a plurality of the first flow path members 50 by butting adhesion successively. In this butting adhesion, the ejection module 200 is conveyed by means of the pickup arm 504 and while performing position correction, the ejection module 200 is placed on the first flow path member 50 to which the adhesive 513 has been applied thinly. The position correction is performed as in the First Embodiment by referring to an arrangement mark by using a camera 506. This makes it possible to adjust variation in the position of the recording element substrates 10 in the horizontal plane to a desired value or less. In the present embodiment, variation in height of the joint surface with the ejection module 200 among the first flow path members 50 is small and by the step (c), the thickness tolerance of the ejection module 200 is reduced. It becomes unnecessary to maintain and manage the height of the ejection orifice face to a predetermined value by the pickup arm 504 in the step (d) and butting adhesion can therefore be employed in the step (d). This leads to shortening of a manufacturing tact for the constitution of the liquid ejection head 3. The above-described steps can thus provide a long liquid ejection head 3 having a less difference in height of the ejection orifice face among the recording element substrates 10 and at the same time, having high position accuracy among the recording element substrates 10.

Fourth Embodiment

FIGS. 16A to 16D are schematic views successively showing steps of joining members with an adhesive to form a liquid ejection unit 300 in the Fourth Embodiment. FIGS. 16A to 16D show steps (a) to (d) in the present embodiment, respectively. The steps (a) to (c) are similar to the steps (a) to (c) in the Third Embodiment. In the step (d) of the present embodiment, different from the Third Embodiment, the ejection module 200 is joined with the first flow path members 50 by floating adhesion. This floating adhesion is performed as in the step (c) of the Second Embodiment. The Fourth Embodiment has an advantage that the thickness of the adhesive applied to each member can be reduced in the case where the thickness tolerance of the recording element substrate 10 and the support member 30 is large and at the same time, variation in height of the joint surface with the ejection module 200 is large among the first flow path members 50. This advantage is brought about because floating adhesion is performed for the respective layers of adhesives 511 to 513 and due to three layers provided for absorbing the thickness tolerance of each member and flatness tolerance at the joint surface, variation in thickness absorbed by one adhesive layer decreases. The Fourth Embodiment, therefore, facilitates use of an adhesive having difficulty in thick application, reduces a projection amount of an unnecessary portion of the adhesive, and reduces the risk of clogging of a flow path with the projected adhesive.

The invention can provide a liquid ejection head capable of reducing variation in the position of an ejection orifice face among recording element substrates and improving the flatness of the ejection orifice face with respect to a recording medium at a low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-129726, filed Jun. 30, 2017, which is hereby incorporated by reference herein in its entirety.

What is claimed is:

1. A liquid ejection head comprising:

a plurality of ejection modules having a recording element substrate equipped with a plurality of ejection orifices for ejecting a liquid;

a plurality of first flow path members that support at least one of the ejection modules; and a second flow path member provided in common with the first flow path members and supporting the first flow path members, wherein the first flow path members and the second flow path member are equipped with a flow path for supplying the recording element substrate with the liquid and the first flow path members are joined with the second flow path member via an adhesive layer without being brought into direct contact with the second flow path member.

2. The liquid ejection head according to claim 1, wherein each of the ejection modules has the recording element substrate and a support member that supplies the recording element substrate with the liquid supplied via the first flow path members and that supports the recording element substrate.

3. The liquid ejection head according to claim 2, wherein the recording element substrate and the support member are joined via an adhesive layer without being brought into direct contact with each other.

4. The liquid ejection head according to claim 2, wherein the support member and the first flow path members are joined via an adhesive layer without being brought into direct contact with each other.

5. The liquid ejection head according to claim 2, wherein a joint surface of the support member with the recording element substrate has a flatness higher than a flatness of a joint surface of the first flow path members with the support member.

6. The liquid ejection head according to claim 2, wherein a material constituting the support member has a thermal conductivity greater than a thermal conductivity of a material constituting the first flow path members.

7. The liquid ejection head according to claim 1, wherein the liquid ejection head is a page-wide type and the recording element substrates are arranged in a straight line along the longitudinal direction of the liquid ejection head.

8. The liquid ejection head according to claim 1, wherein the ejection modules are arranged in a first direction and at the same time, in each of the ejection modules, the ejection orifices of the recording element substrate of the ejection module are arranged at an acute angle with respect to the first direction.

9. The liquid ejection head according to claim 1, wherein the recording element substrate comprises, corresponding to each of the ejection orifices, a recording element that generates liquid ejecting energy, a pressure chamber having therein the recording element, a liquid supply path for supplying the pressure chamber with the liquid and a liquid collection path for collecting the liquid from the pressure chamber, wherein the liquid inside the pressure chamber is circulated between inside and outside of the pressure chamber.

10. The liquid ejection head according to claim 9, wherein the second flow path member comprises a common supply flow path that supplies the pressure chamber with the liquid and that extends along the longitudinal direction of the liquid ejection head, and a common collection flow path that collects the liquid from the pressure chamber and that extends along the common supply flow path, and wherein the common supply flow path and the common collection flow path communicate with the liquid supply path and the liquid collection path, respectively, via the first flow path members.

11. A liquid ejection apparatus, comprising:

the liquid ejection head as claimed in claim 10, a storage unit that stores a liquid therein, a first circulation system that circulates the liquid from the storage unit via the common supply flow path, and a second circulation system that circulates the liquid from the storage unit via the common collection flow path.

12. A liquid ejection apparatus, comprising:

the liquid ejection head as claimed in claim 1, and a storage unit that stores a liquid therein.

13. A method of manufacturing the liquid ejection head as claimed in claim 1, comprising:

a step of placing the first flow path members at a predetermined position on a first stage while turning a joint surface of the members with the ejection module in a downward vertical direction;

a step of applying an adhesive to at least one of a joint surface of the second flow path member with the first flow path members and a joint surface of the first flow path members with the second flow path member, except at an opening for a flow path;

a step of installing the second flow path member on a second stage so that the second flow path member is positioned in a upward vertical direction of the first flow path members placed at the predetermined position on the first stage while turning the joint surface of the second flow path member with the first flow path members in a downward vertical direction; and a step of moving at least one of the first stage and the second stage in a vertical direction to join the first flow path members with the second flow path member with the adhesive without bringing them into direct contact with each other.

14. The manufacturing method according to claim 13, wherein an application thickness of the adhesive is greater than a sum of a thickness tolerance of the first flow path members and flatness of the joint surface of the second flow path member with the first flow path members.

* * * * *